US009525944B2

(12) United States Patent
Clemen, Jr.

(10) Patent No.: US 9,525,944 B2
(45) Date of Patent: Dec. 20, 2016

(54) APPARATUS AND METHOD FOR AN ACTIVE AND PROGRAMMABLE ACOUSTIC METAMATERIAL

(71) Applicant: The Boeing Company, Chicago, IL (US)

(72) Inventor: Mark Joseph Clemen, Jr., Bremerton, WA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 14/452,039

(22) Filed: Aug. 5, 2014

(65) Prior Publication Data

US 2016/0044417 A1 Feb. 11, 2016

(51) Int. Cl.

| | |
|---|---|
| ***G10K 11/16*** | (2006.01) |
| ***H04R 7/06*** | (2006.01) |
| ***G10K 11/178*** | (2006.01) |
| ***G10K 15/08*** | (2006.01) |
| ***G10K 15/10*** | (2006.01) |

(52) U.S. Cl.

CPC ..... *H04R 7/06* (2013.01); *G10K 11/178* (2013.01); *G10K 11/1786* (2013.01); *G10K 11/1788* (2013.01); *G10K 15/08* (2013.01); *G10K 15/10* (2013.01); *G10K 2210/103* (2013.01); *G10K 2210/118* (2013.01); *G10K 2210/12* (2013.01); *G10K 2210/1281* (2013.01); *G10K 2210/3214* (2013.01); *G10K 2210/3215* (2013.01); *G10K 2210/3217* (2013.01); *G10K 2210/3219* (2013.01)

(58) Field of Classification Search

CPC ..... G10K 11/1788; F01N 1/065; H04R 7/06
USPC ..... 381/71.7
See application file for complete search history.

(56) References Cited

U.S. PATENT DOCUMENTS

| | | | | |
|---|---|---|---|---|
| 4,025,724 | A | 5/1977 | Davidson, Jr. et al. | |
| 4,361,727 | A | 11/1982 | Franssen et al. | |
| 6,041,125 | A | 3/2000 | Nishimura et al. | |
| 6,343,129 | B1 * | 1/2002 | Pelrine | F04B 35/045 381/116 |
| 8,172,036 | B2 | 5/2012 | Tanielian | |
| 8,579,073 | B2 | 11/2013 | Sheng et al. | |
| 2005/0232435 | A1 | 10/2005 | Stothers et al. | |
| 2010/0289715 | A1 | 11/2010 | Cummer et al. | |

(Continued)

FOREIGN PATENT DOCUMENTS

| | | | |
|---|---|---|---|
| DE | 19946083 | A1 | 3/2001 |
| EP | 1211668 | A1 | 6/2002 |

OTHER PUBLICATIONS

Popa et al., "Tunable active acoustic metamaterials," Physical Review B 88, 024303 (2013), Department of Electrical and Computer Engineering, Duke University, American Physical Society, Jul. 16, 2013, pp. 024303-1-024303-8.

(Continued)

*Primary Examiner* — Simon King
(74) *Attorney, Agent, or Firm* — Yee & Associates, P.C.

(57) ABSTRACT

An acoustic metamaterial including cells to digitally process an incoming sound waveform, and to produce a corresponding response sound waveform as a function of a frequency and a phase of the incoming sound waveform, to produce a total response sound waveform that, when combined with the incoming sound waveform, modifies the incoming sound waveform.

19 Claims, 13 Drawing Sheets

(56) References Cited

U.S. PATENT DOCUMENTS

| | | | | |
|---|---|---|---|---|
| 2011/0274283 | A1* | 11/2011 | Athanas ..... | G10K 11/1782 381/71.7 |
| 2012/0189128 | A1 | 7/2012 | Maillard et al. | |
| 2013/0025961 | A1 | 1/2013 | Koh et al. | |
| 2013/0034246 | A1 | 2/2013 | Kano | |
| 2013/0156209 | A1 | 6/2013 | Visser et al. | |

OTHER PUBLICATIONS

Peart, "Flyover-Noise Measurement and Prediction," National Aeronautics and Space Administration Publication 1258, "Aeroacoustics of Flight Vehicles: Theory and Practice; vol. 2: Noise Control," pp. 357-382, Aug. 1991.

Partial European Search Report, dated Feb. 17, 2016, regarding Application No. EP15176346.3, 8 pages.

Extended European Search Report, dated Jun. 29, 2016, regarding Application No. EP15176346.3, 16 pages.

* cited by examiner

APPARATUS AND METHOD FOR AN ACTIVE AND PROGRAMMABLE ACOUSTIC METAMATERIAL

BACKGROUND INFORMATION

1. Field

The present disclosure relates generally to modifying sound. The present disclosure relates specifically to materials including individual cells which act together to modify sound waves.

2. Background

Modification of sound is desirable in many circumstances, such as reducing sound by using headphones that cancel surrounding noise. Devices for use in larger applications, for example on aircraft and other vehicles to reduce or redirect sound have many useful military and commercial applications.

Passive techniques for reducing the noise in aircraft and other vehicles are known. For example, vehicle structures may be provided with passive foams, beads, acoustic blankets, or other materials to absorb sound energy. However, such devices typically add considerable undesired weight and are not able to regulate the amount of sound transmitted or received. Active noise cancellation techniques, such as the headphones described above, are not practical for use with large structures, such as aircraft and vehicles. Thus, methods and devices for modifying the amount of sound made by vehicles and other devices using only lightweight and strong materials are desirable.

SUMMARY

The illustrative embodiments may take many different forms. For example, the illustrative embodiments provide for an acoustic metamaterial including cells to digitally process an incoming sound waveform, and to produce a corresponding response sound waveform as a function of a frequency and a phase of the incoming sound waveform, to produce a total response sound waveform that, when combined with the incoming sound waveform, modifies the incoming sound waveform.

The illustrative embodiments also provide for a structural metamaterial including cells, each cell containing a microphone to detect incoming sound waveforms, a speaker, and a processor configured to analyze the features of an incoming sound waveform and to cause the speaker to emit a response waveform that, when combined with the incoming sound waveform at the given corresponding cell, modifies the incoming sound waveform.

The illustrative embodiments also provide for a method. The method includes receiving a sound waveform at cells, wherein each cell receives a corresponding part of the sound waveform, and wherein each cell comprises a microphone, a processor, and a speaker. The method also includes modeling, by each processor, a part of the sound waveform to form a model. The method also includes emitting, by each speaker as commanded by each processor, a response waveform, based on the model, that when combined with the part of the sound waveform, modifies the part of the sound waveform.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

Figure 1:
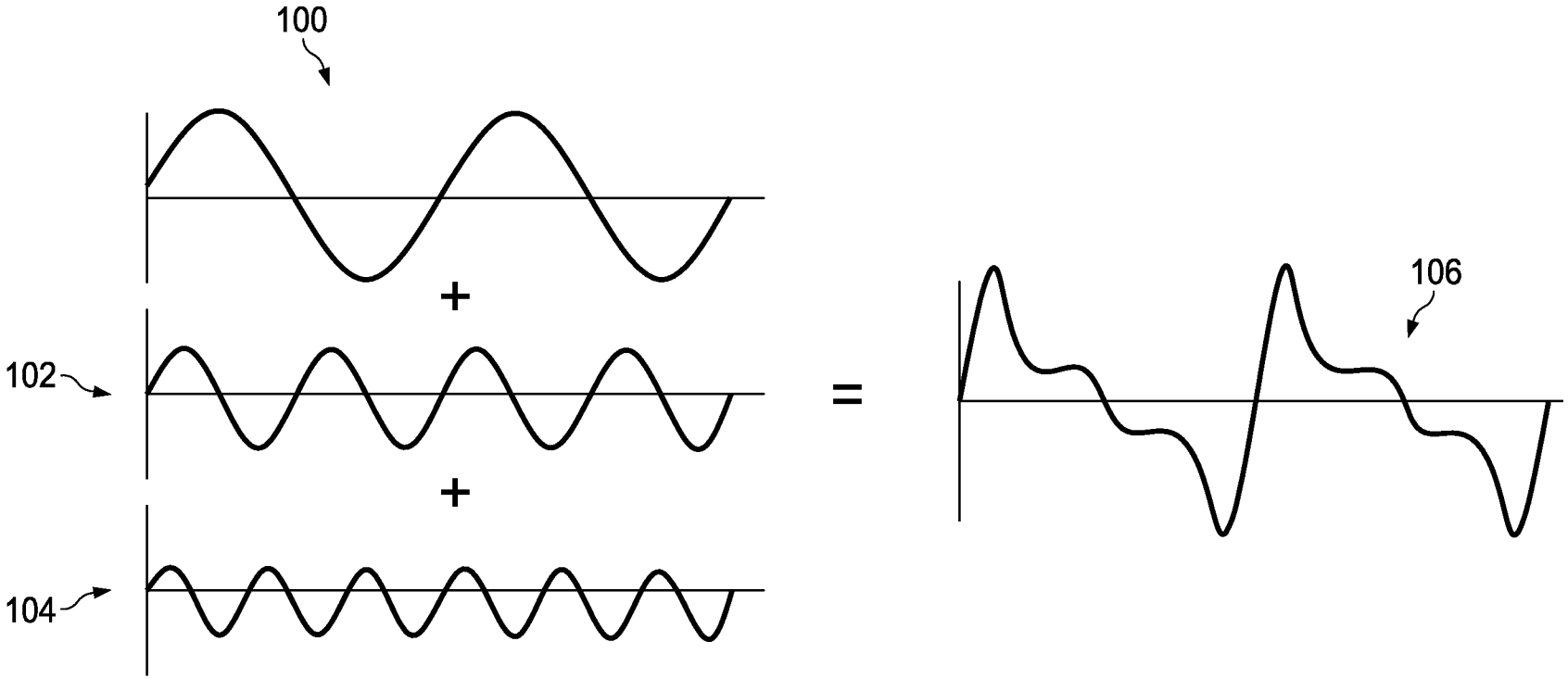
FIG. 1 (PRIOR ART)
FIG. 1 illustrates superposition of waves.

The illustrative embodiments provide several useful functions. For example, the illustrative embodiments recognize and take into account that it is difficult to actively modify the sound produced by large objects, such as vehicles including aircraft. The illustrative embodiments also recognize and take into account that passive sound modification techniques for sound from large objects such as aircraft, are often inadequate, heavy, or otherwise undesirable. The illustrative embodiments provide alternatives to these issues by providing a structure composed of many cells that modify or cancel sound. Each cell is configured to detect, measure and then modify at least part of a sound wave striking or moving through the structure by altering the sound waves reflected from or transmitted through the structure. The term "part of a sound wave" may refer to a portion of a sound wave contained in a defined section of three-dimensional space in which some but not all of the sound wave is located. Each individual cell may be in wireless or wired communication with each other and/or with a central processor. Thus, the cells may be programmable to regulate incoming sound upon striking the structure of cells.

The structure of cells may be termed an acoustic metamaterial, a structural metamaterial, or may have other names. The structure of cells may take the form of a skin of an aircraft or other vehicle, a panel, a wall, or any other convenient form, and may be bent, curved, or have other shapes. The structure may be flexible or rigid.

Because the acoustic metamaterial includes many different cells, and can have many desired shapes, the acoustic metamaterial is capable of modifying sound striking any part of a covered structure. Thus, for example, part of or an entire aircraft could be covered in part or entirely by an acoustic metamaterial. In a specific non-limiting example, the acoustic metamaterial may be configured to cancel sound generated by the aircraft during operation, increasing the ease of complying with noise ordinance and regulations.

However, the illustrative embodiments are not limited to aircraft. The illustrative embodiments may be applied to any type of vehicle, including automobiles, watercraft, helicopters, tanks, submarines, and other vehicles. The illustrative embodiments also may be applied to buildings, or to specific rooms within buildings, in order to actively modify sound generated within or outside of a building. If carried, the illustrative embodiments could also be used to modify the sound produced by a human or a mobile robot. Thus, the illustrative embodiments are not necessarily limited to aircraft or specific vehicles.

The modification of the propagation of sound waves in materials can be further advantageous in the broadcast of sound, where a large structure is tuned to amplify and transmit a beam of sound on a forward side from a point on the reverse side, as an optical lamp may have a collimating lens on its face. This material can be programmed in situ to provide a graded "index of refraction" to sound waves, just as an optical gradient lens may be fashioned for light waves. In another application, the invention may be useful for the improvement of emitting and sensing apparatus, such as an ultrasound tomography device, for otherwise non-traditional blanketing shapes to the transducer head.

FIG. 1 illustrates superposition of waves. As is well-known in the art, sound consists of waves propagating through a medium such as air or water. In turn, sound waves may be modified by the principle of superposition. The principle of superposition states that if a number of independent influences act on a system, the resultant influence is the sum of the individual influences acting separately. In the case of sound waves, when two waves are superimposed over each other, then the waves are combined. The result is a combined, different wave.

This principle is commonly heard in music, where two different notes (sounds) may combine to produce an entirely different sound, which may be harmonic or dissonant. In another example, sounds that have opposing waveforms may cancel each other out, resulting in quiet or near quiet. In another example, sounds that have the same waveforms may reinforce each other, producing an even louder (more energetic) sound.

Thus, as shown in FIG. 1, sound 100 has a first waveform, sound 102 has a second waveform, and sound 104 has a third waveform. These three sound waveforms, if superimposed on each other, produce combined sound waveform 106. Note that combined sound waveform 106 has a different appearance than any of the other three sound waveforms, and a person will hear sound waveform 106 differently than any of the other three sound waveforms.

Figure 2:
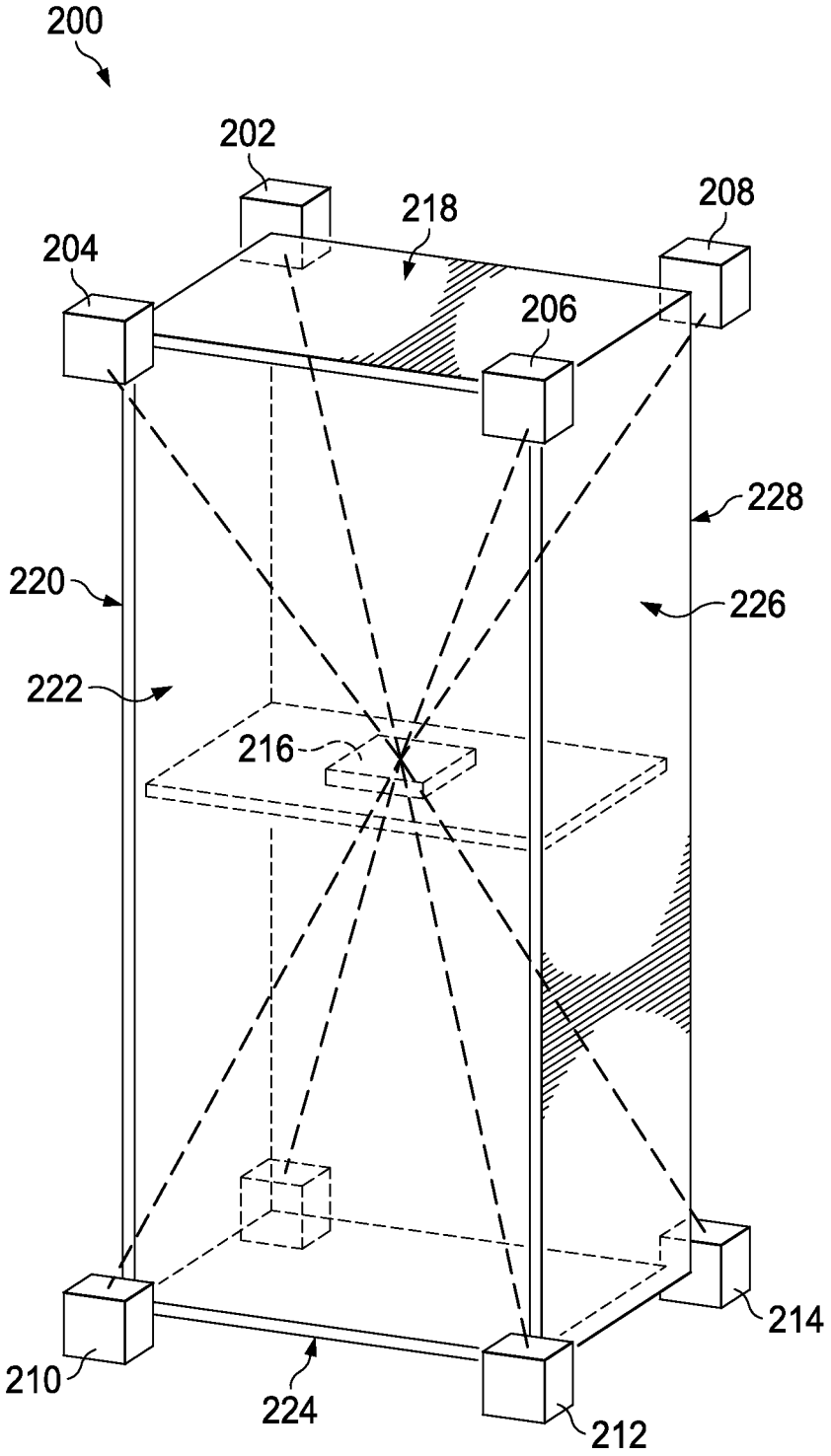
FIG. 2 illustrates an individual cell useful for modifying an incoming sound wave, in accordance with an illustrative embodiment.

FIG. 2 illustrates an individual cell useful for modifying an incoming sound wave, in accordance with an illustrative embodiment. Non-limiting examples of sound waves are shown in FIG. 1. The illustrative embodiments take advantage of the principle of superposition described with respect to FIG. 1. Specifically, the illustrative embodiments use an array of cells, such as cell 200, to modify local areas (areas near individual cells) of even complex sound waveforms. The net outputted or reflected waveform may be actively modified by emitting sound waveforms calculated to modify the incoming sound waveform to have a desired property.

Figure 4:
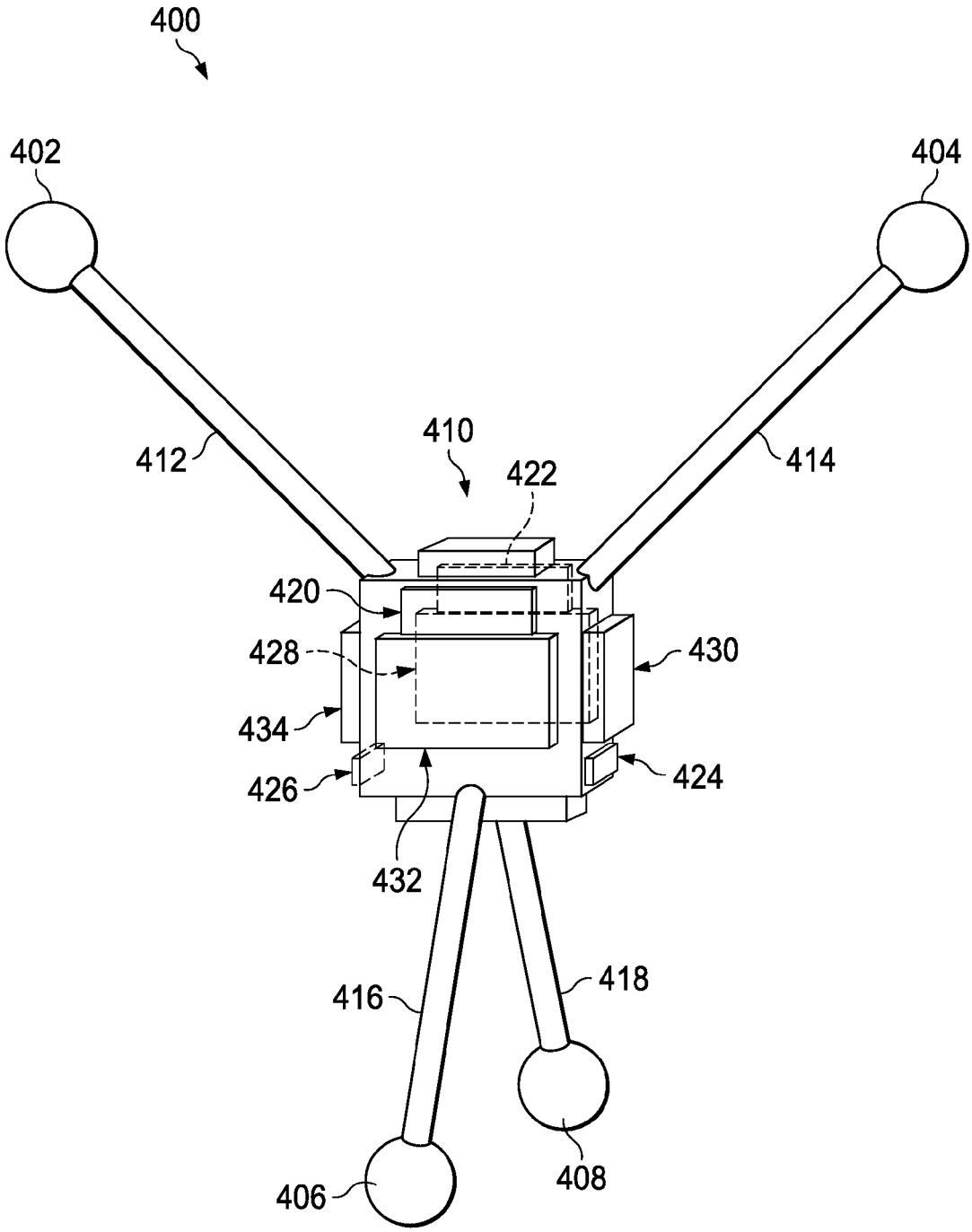
FIG. 4 illustrates an example of a cell including a central hub containing a processor and a speaker, a set of four beams, each comprising a solid material and further comprising a digital communications line.

Cell 200 is presented as an abstract representation, cell 200 may take many different forms. A specific example of cell 200 is shown in FIG. 4.

Cell 200 may be termed a body centered cubic cell unit. Cell 200 includes a number of microphones, a number of speakers, and a number of signal processors. Some of these devices may be combined into a single device, though in an illustrative embodiment a physical distance separates at least the microphones and the other devices included in cell 200. The microphones, in an illustrative embodiment, may be closer to an exterior of cell 200 relative to the other components of cell 200.

In the illustrative embodiment shown in FIG. 2, eight microphones are shown, including microphone 202, microphone 204, microphone 206, microphone 208, microphone 210, microphone 212, and microphone 214. More or fewer microphones could be provided.

Each of these microphones are in wireless or wired communication with signal processor 216. Signal processor 216 may be data processing system 1700 of FIG. 17, or may any other computer or application specific integrated circuit (ASIC). Signal processor 216 need not be located in the physical center of cell 200, though as shown in FIG. 2, signal processor 216 is in the physical center of cell 200. More signal processors may be present. In some cases, signal processor 216 may be located outside of cell 200.

In addition, cell 200 includes a number of speakers. In the non-limiting example of FIG. 2, six speakers are provided, including speaker 218, speaker 220, speaker 222, speaker 224, speaker 226, and speaker 228. These speakers may be part of the "walls" shown in FIG. 2, though need not take the form of walls. For example, as shown in FIG. 4, the speakers may be part of a central hub to which signal processor 216 belongs.

Figure 5:
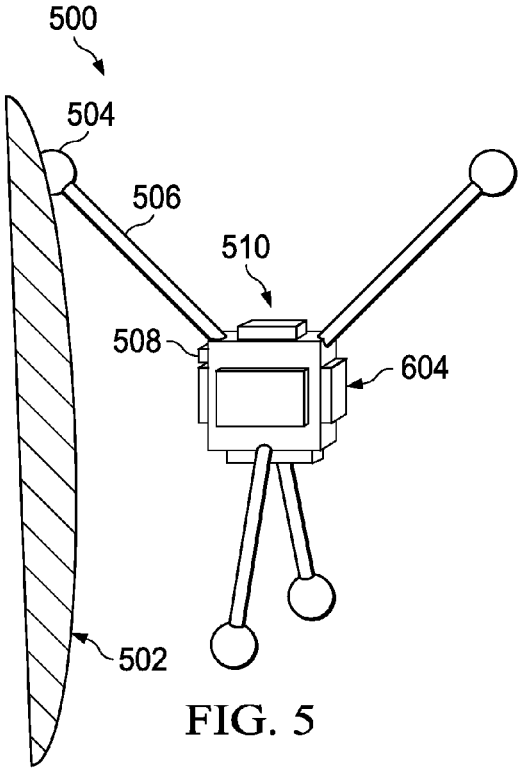
FIG. 5 illustrates an incoming sound wave beginning to strike the cell shown in FIG. 4, in accordance with an illustrative embodiment.
Figure 6:
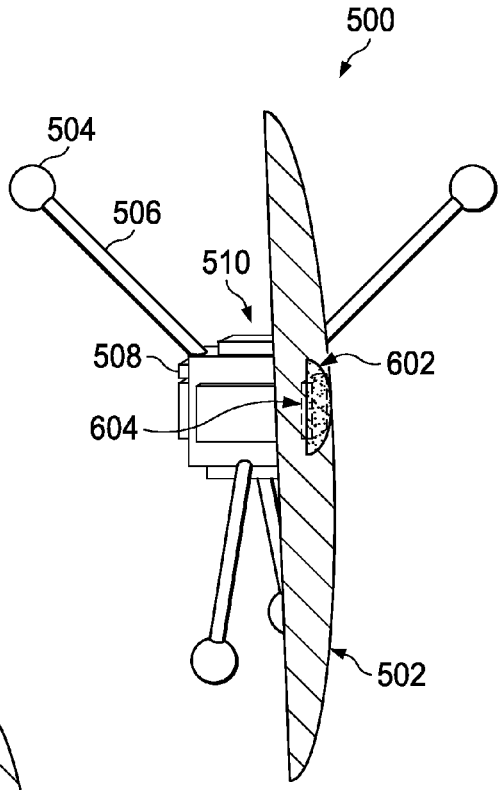
FIG. 6 illustrates the incoming sound wave having moved about half way past the cell shown in FIG. 5, in accordance with an illustrative embodiment.
Figure 7:
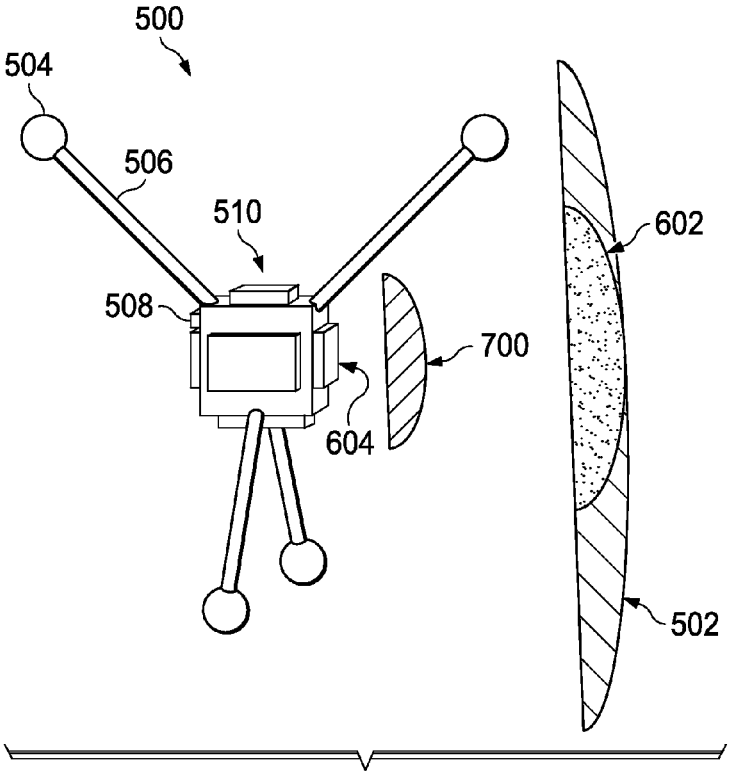
FIG. 7 illustrates a modified sound wave, relative to the incoming sound wave shown in FIG. 5, in accordance with an illustrative embodiment.

In use, and as shown further with respect to FIG. 5 through FIG. 7, when an incoming sound wave strikes cell 200, it will first strike one or more of the microphones. The microphones convert received sound energy into signals. Each microphone produces its own signals. The combination of all signals from the microphones is received at signal processor 216. In turn, signal processor 216 analyzes the combination of all signals and mathematically characterizes the portion of the sound wave striking cell 200.

Subsequently, signal processor 216 transmits commands to the speakers to emit an emitted sound wave having characteristics determined by signal processor 216. These characteristics of the emitted sound wave are configured to combine with characteristics of the incoming sound waveform, according to the principle of superposition, to produce a total waveform that has desired characteristics.

Note that the total time needed for the signals to be transmitted from microphone to the signal processor, plus the time for the signals to be processed by signal processor 216, plus the time for the commands to be transmitted to speakers, is much less than the time required for the sound wave to traverse the distance across cell 200. Even for small cells, for example the approximate size of an adult human fingernail, the speed of modern signal processing is sufficient to send and receive signals and to perform all processing faster than the sound can traverse cell 200.

Modification of the incoming sound waveform may take many different embodiments. For example, if sound cancellation is desired, then the emitted sound waveform may be the same as the incoming sound waveform, but out of phase so that the two waveforms tend to cancel each other. If sound enhancement is desired, then the emitted sound waveform may be the same as the incoming sound waveform, but in phase so that the two waveforms tend to reinforce each other to produce a louder sound. If sound modification is desired, then the emitted sound waveform may be configured such that the resulting combined sound waveform has desired characteristics. For example, a roar of a jet engine might be modified to sound like a hum. In another example, a particular aircraft may have a characteristic sound that is modified so that the particular aircraft sounds like another aircraft. For example, a sound made by a jet is distinctive; this sound could be modified so that the jet sounds more like a helicopter or perhaps sound like a flock of birds. Many different sound modifications are possible; thus, these examples should not be considered as limiting the claims or any other illustrative embodiment described herein.

Figure 3:
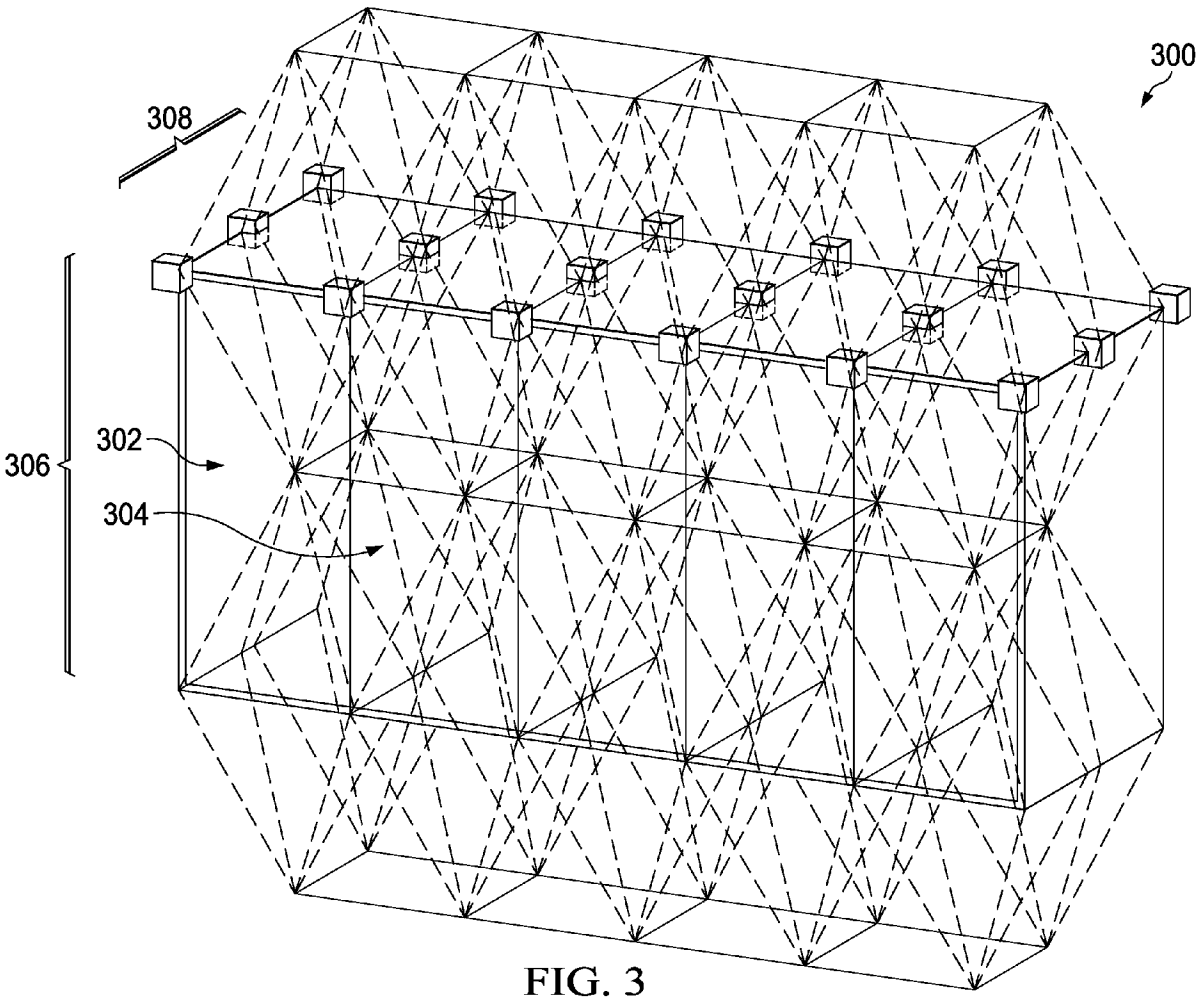
FIG. 3 illustrates an array of cells useful for modifying different parts of an incoming sound wave, in accordance with an illustrative embodiment.

FIG. 3 illustrates an array of cells useful for modifying different parts of an incoming sound wave, in accordance with an illustrative embodiment. Each of the cells shown in array 300 may be, for example, cell 200 shown in FIG. 2. Thus, for example, cell 302 and cell 304, as well as any of the other cells in FIG. 3, could be cell 200 of FIG. 2.

Array 300 may include more or fewer cells than those shown in FIG. 3. However, the example of array 300 includes an array of one cell in depth, as shown by brackets 306, of two cells in width, as shown by brackets 308. More or fewer rows and columns of cells may be present. Array 300 need not have a series of touching cells, as shown in FIG. 3, but could include many cells that do not touch each other but communicate wirelessly with each other and/or with a central processing unit. Array 300 may have a number of different shapes; for example, the cells shown in array 300 may be arranged in a ring, a helical pattern, a single wall, or any desired arrangement.

Array 300 may be covered by a skin, one or more panels, or other objects such that array 300 may be handled as a single object. In this manner, array 300 may form part of the outer fuselage of an aircraft.

In use, array 300 operates in a similar manner as the operation described with respect to cell 200 of FIG. 2. Use of array 300 may be different in some respects. For example, a central processing unit may coordinate all of the different signal processors of the individual cells. However, the signal processors may communicate with each other; thus, a central processing unit should be considered optional.

Use of array 300 has several advantages over use of a single cell. First, several cells can be arranged in a desired shape, which is useful when fabricating a vehicle or a room. Second, several cells can characterize individual local areas of complex incoming sound that covers a wide area. For example, for an incoming sound that is complex and covers large area, a local cell of array 300 modifies only the component of the incoming sound in the area around that local cell. However, the combination of all cells working together may modify, cancel, or enhance even complex sounds that are distributed over a wide area. Third, arrays of cells may add to, or at least not detract from, the strength of a structure. This feature may be useful in vehicles as well as in buildings.

FIG. 4 illustrates a specific example of a cell useful for modifying an incoming sound wave, in accordance with an illustrative embodiment. Cell 400 may be a specific example of cell 200 of FIG. 2. However, many different cell structures and arrangements of components within the cell are possible; thus, the example of cell 400 does not necessarily limit the claimed inventions or other illustrative embodiments described herein. Cell 400 may be referred to as a tetrahedral sub-cell, as it has four leads. Cell 400 may be also referred to as a diamond-like sub-cell.

Cell 400 includes four microphones, including microphone 402, microphone 404, microphone 406, and microphone 408. Each of these microphones may be some other sensor capable of measuring sound.

Each of these microphones is spaced outwardly from central hub 410. In an illustrative embodiment, each microphone is physically connected to central hub 410 via a digital communication line. Thus, microphone 402 is connected to central hub 410 via digital communication line 412; microphone 404 is connected to central hub 410 via digital communication line 414; microphone 406 is connected to central hub 410 via digital communication line 416; and microphone 408 is connected to central hub 410 via digital communication line 418. However, in other illustrative embodiments, these microphones need not be physically connected to central hub 410. Instead, one or more of these microphones may be in wireless communication with central hub 410. More or fewer microphones and digital communication lines may be present.

In the illustrative embodiment shown in FIG. 4, central hub 410 includes multiple digital signal processors, one for each microphone and speaker. Thus, central hub 410 includes digital signal processor 420, digital signal processor 422, digital signal processor 424, and digital signal processor 426. Each digital signal processor receives signals from its corresponding microphone and sends commands to its corresponding speaker. However, in other illustrative embodiments, more or fewer digital signal processor will be present. In some cases, a single signal processor could be present. In some cases the signal processor will be outside of cell 400.

As indicated above, central hub 410 includes four speakers, including speaker 428 (located on the opposite side of central hub 410 relative to the front of the page), speaker 430, speaker 432, and speaker 434. Each speaker corresponds to a digital signal processor in this example. However, more or fewer speakers could be present. The speakers need not be part of central hub 410, but one or more of the speakers could be spaced away from central hub 410.

In use, cell 400 operates in a manner similar to that described with respect to cell 200 of FIG. 2. This operation is described further with respect to FIG. 5 through FIG. 7. Briefly, however, each individual digital signal processor receives signals from each individual microphone. In turn, each individual digital signal processor transmits commands to corresponding speakers to emit sound waves to modify the incoming sound wave detected at a particular microphone. In a sense, cell 400 could include four mini-cells; each mini-cell including one microphone, one digital signal processor, and one speaker.

However, in other illustrative embodiments, cell 400 is a cooperative cell, as for example different digital signal processors could control different speakers. For example, digital signal processor 420 could control speaker 432 after measuring sound at microphone 404. Most generally, each digital signal processor may receive signals from any or all microphone or sensor and then transmit commands to any or all of the speakers.

FIG. 4 illustrates an example of a cell including a central hub containing a processor and a speaker, a set of four beams, each comprising a solid material and further comprising a digital communications line. The cell also includes a set of four sensors connected at corresponding ends of the set of four beams, opposite the central hub of each cell. In an illustrative embodiment, the central hub contains a plurality of additional separate processors and a plurality of additional separate speakers.

FIG. 5 through FIG. 7 illustrate an example of cell 400 of FIG. 4 in use. Thus, in all three Figures, each depiction of cell 500 corresponds to a single cell at three different times. Cell 500 may be, for example, cell 400 of FIG. 4 or cell 200 of FIG. 2. In particular, FIG. 5 illustrates an incoming sound wave beginning to strike the cell shown in FIG. 4, in accordance with an illustrative embodiment. In turn, FIG. 6 illustrates the incoming sound wave having moved about half way past the cell shown in FIG. 5, in accordance with an illustrative embodiment. In turn, FIG. 7 illustrates a modified sound wave, relative to the incoming sound wave shown in FIG. 5, in accordance with an illustrative embodiment.

FIG. 5 through FIG. 7 are described together. Thus, similar reference numerals refer to similar objects for these three Figures.

In the examples shown in FIG. 5 through FIG. 7, incoming sound wave 502 (which may be termed an incoming sound impulse) encounters microphone 504. Microphone 504 measures incoming sound wave 502, and transmits these measurements as signals along digital communication line 506 to digital signal processor 508 in central hub 510. As the waveform continues to pass through cell 500, as shown in FIG. 6 and FIG. 7, other microphones will be struck by incoming sound wave 502, and subsequently other measurements may be sent to one or more other digital signal processors.

FIG. 6 shows a first response, which is to emit emitted sound wave 602 from speaker 604. Emitted sound wave 602 generates a phase cancellation of the incident signal generated as a result of incoming sound wave 502 striking microphone 504. Emitted sound wave 602 will modify incoming sound wave 502 according to the principle of superposition.

FIG. 7 shows a second response, which is to emit emitted sound wave 700 from speaker 604. Emitted sound wave 700 may be emitted in order to account for a change in the index of refraction between the material in which cell 500 is located and the surrounding medium, such as air or water. Emitted sound wave 700 will further modify incoming sound wave 502.

The index of refraction is a quantitative measure of the extent to which a substance slows down a wave as the wave passes through it. The index of a refraction of a substance is proportional to the ratio of the velocity of the wave in a first medium to its speed in a second medium. The value of the index of refraction determines the extent to which a wave is refracted when entering or leaving the substance.

A commonly understood demonstration of an index of refraction, in the case of light waves, is the appearance of a pencil placed in a half-full clear glass containing water. Half the pencil is in the water and half the pencil is outside of the water, and leaning against one edge of the glass. When peering through the outside of the glass with one's eyes level with the center of the pencil, the pencil will appear "bent" or "discontinuous", as if the pencil were located at different places inside and outside the boundary of the water. However, the pencil is not actually bent or discontinuous, it only appears that way because the light reflected by the pencil is bent as a result of the change in the speed of light in the two mediums (air versus water). This effect is caused by the index of refraction created by the boundary of the air and water. Note that while the speed of light in a vacuum is always a constant, the speed of light in a medium such as air or water is not constant and will slow relative to the speed of light in a vacuum. Light moves through water slightly slower than light moves through air, and the change in the speed of light in the two media results light being bent differently in each media, creating a "bending" or "broken" appearance of the pencil at the boundary between the water and the air.

This same principle applies in sound waves. The speed of sound is different in different media, tending to be slower in denser media. Thus, in order to account for the change in index of refraction between the surrounding media and the acoustic metamaterial of which the surrounding media and the acoustic metamaterial of which cell 500 is a part, digital signal processor 508 takes into consideration the change in sound arising from the change in index of refraction. Thus, one or more digital signal processors in cell 500 will command one or more speakers, such as speaker 604, to emit emitted sound wave 700 to account for the change in index of refraction between the acoustic metamaterial of which cell 500 is a part and the surrounding media. In an illustrative embodiment, emitted sound wave 602 may be modified to account for the change in the index of refraction. However, emitted sound wave 700 may be useful to account for phase delays between sound waves that occur at the boundary between two materials.

Attention is now turned to a technical, yet abstract (as opposed to mathematical) description of an algorithm for performing sound wave modification. Initially, one or more microphones detect an incoming acoustic wave. The microphone's sensor values are digitized in time for further processing by a digital signal processor. The digital signal processor converts the signal to frequency-space. The digital signal processor adds phase shifts (time delays) by frequency bin as appropriate to achieve the desired modified sound waveform for the particular metamaterial properties of the acoustic metamaterial. The digital signal processor may also create a separate waveform tailored to cancel the propagation of the original wave. The digital signal processor then converts the frequency space characterizations of the modified waves back to time-space, and transmits the time-space characterized waves to the speakers. In turn, the speakers broadcast the sum of the active cancellation of the wave and the processed meta-response.

Ultimately, each digital signal processor performs a fast Fourier transform (FFT) of the incoming signal, performs digital filtering, applies a direction-finding algorithm, two phase shifts, and an inverse fast Fourier transform (IFFT) before the initial audio signal propagates from the microphone to the speaker plane. This time is roughly on the order of microseconds. In an illustrative embodiment, for a one inch cell and based on the approximate speed of sound, the time allotted for performing these calculations may be about 77 microseconds, but may vary between about 50 and 100 microseconds. The time allotted may be increased proportionally for thicker cells. In any case, modern miniature digital signal processors are capable of performing the desired calculations at this speed.

Again, the algorithm can be summarized as follows: First, transform incoming sound samples from time-space to frequency space. This transformation may be performed using a standard fast Fourier transform, or expedited using a logarithmic fast Fourier transform. Second, perform frequency filtering to match a band pass of speaker response. Third, perform direction finding to identify a three-dimensional directionality of the incoming sound wave, and the appropriate component to be broadcast by each downstream speaker. Fourth, calculate a phase shift for an emitted waveform along the three-dimensional direction of the incoming sound wave that, when combined with the incoming waveform, will result in a desired refracted waveform according to the principle of super position. Fifth, transform the phase-shifted waveform back into time-space. Sixth, order one or more speakers to emit the phase shifted time-space waveform.

This algorithm may be repeated as necessary or desired in subsequent time increments for new incoming sound waves. Each time increment may be, for example, the time taken to propagate a signal from a microphone to the central hub. Thus, each time increment may be on an order of one microsecond or less. Accordingly, any given digital signal processor may be continually processing multiple incoming or changing sound waveforms, and ordering speakers to emit emitted sounds accordingly to achieve a desired total sound output over time.

Attention is now turned to the mathematical descriptions used in the above algorithm. The method is conveniently implemented with a fast Fourier transform or similarly a Laplace transform. A logarithmic Fourier transform or a fast Hankel transform (FHT) convolution filtering technique can additionally be employed to expedite the calculation time by decreasing the number of frequency space bins required in the calculation. This approach leads to an exact, analytical expression for the full frequency space version of that time-sampled function. When a logarithmic Fourier transform is used to optimize the algorithm speed, then the above algorithm which, for a function defined numerically on a logarithmic mesh in the radial coordinate, generates the spherical Bessel, or Hankel, transform on a logarithmic mesh in the transform variable. Accurate results for large values of the transform variable are obtained that would otherwise be unattainable. The above algorithm treats the mathematical problem as a convolution. The calculation then uses two applications of the fast Fourier transform method. The procedure is most applicable to smooth functions defined on (0, ∞) with a limited number of nodes.

The fast Fourier transform log algorithm for taking the discrete Hankel transform of a sequence of $a_n$ of N logarithmically spaced points is defined as follows (following the method of Talman, J. Comp. Phys. 29 (1978) p35): The fast Fourier transform of $a_n$ to obtain the Fourier coefficients $c_m$ is:

$$c_m = \frac{1}{N}\sum_{n=-\frac{N}{2}}^{\frac{N}{2}} a_n e^{-2\pi i m n/N} \tag{1}$$

Multiply by $u_m$ to obtain the product $c_m u_m$, where $U_m$ is:

$$u_m = (k_\theta r_\theta)^{-2\pi i m n/L} 2^{\left(q+\frac{2\pi i m}{L}\right)} \frac{\Gamma\left[\left(\mu+1+q+\frac{2\pi i m}{L}\right)/2\right]}{\Gamma\left[\left(\mu+1+q+\frac{2\pi i m}{L}\right)/2\right]} \tag{2}$$

Where μ is the order of the Hankel transform, q is a parameter of the Hankel transform, and k is the wave number of the incoming waveform.

Then, fast Fourier transform $c_m u_m$ back to obtain the discrete Hankel transform, $\tilde{a}_n$:

$$\tilde{a}_n = \sum_{m=-\frac{N}{2}}^{\frac{N}{2}} c_m u_m e^{-2\pi i m n/N} \tag{3}$$

The inverse discrete Hankel transform is accomplished by the same series of steps, except that $c_m$ is divided instead of multiplied by $u_m$.

The illustrative embodiments contemplate the three-dimensional nature of sound propagation. Thus sound waves have properties in the X (horizontal), Y (transverse horizontal), and Z (vertical) directions. In the case that the sound wave is primarily propagating in the X direction, the sound wave proceeds from a point "−X" (such as a microphone) to a point "+X" (such as a speaker) relative to a central point (such as a central hub). Audio signals received at time "T" from the Y or Z directions are a common mode baseline to be subtracted time-point by time-point. This information is subtracted out so that the characteristics of the incoming wave are known as accurately as possible along each direction. Note that similar procedures to those described below can be performed for waves propagating primarily along the Y or Z directions.

The fast Fourier transform of the detected signals in each of the microphones in one cell is calculated in the standard way. Regardless of the frequency transform used, let the detected and filtered input signals be defined as F(t) when expressed as a function of time, and f(s) when transformed to frequency. In one implementation, "f(s)" is the fast Fourier transform of "F(t)", which is the detected waveform.

The component of an incoming wave to any one specific direction-axis may be derived in the direction-finding algorithm as follows. Assume two microphones along this axis, one at each end of a meta-cell. Call this direction 'x'. At any one time, an acoustic wave propagating across the cell will have components along this axis and perpendicular to this axis. Since the cell is presumed to be "small" compared to a wavelength, then the acoustic components propagating perpendicular to this example axis will—over the time of a sequence of audio samples—add up to a common baseline to both of these on-axis microphones. The components in the 'y' and 'z' directions will act as a common mode to the 'x'-axis signature in time. Call this common mode $F_c(t)$. Assume, for this example, that the time 't' is such that (t=0) is the moment that a wave front passes the center, and "a" is the time difference from a microphone to the center of a cell for an acoustic wave propagating on axis. The wave front may be travelling along either direction along the X axis. Assume two ends along the axis are defined as "+" and "−", respectively. In this case, for a sequence of time sampled signals on either of these microphones on this sample 'x' axis:

$$F-(t)=Fc(t)+FS-+(t+a) \text{ for signal moving from } - \text{ to } + \quad (4)$$

$$F-(t)=Fc(t)+FS+-(t-a) \text{ for signal moving from } + \text{ to } - \quad (5)$$

$$F+(t)=Fc(t)+FS-+(t-a) \text{ for signal moving from } - \text{ to } + \quad (6)$$

$$F+(t)=Fc(t)+FS+-(t+a) \text{ for signal moving from } + \text{ to } - \quad (7)$$

In General, for signals F1 and F2

$$F-(t)=Fc(t)+F1-+(t+a)+F2+-(t-a) \quad (8)$$

$$F+(t)=Fc(t)+F1-+(t-a)+F2+-(t+a) \quad (9)$$

$$F+(t)-F-(t)=F1-+(t-a)+F2+-(t+a)-F1-+(t+a)-F2+-(t-a) \quad (10)$$

Where F1 is Signal 1 travelling from – to + direction and F2 is Signal 2 travelling from + to – direction. Note that the signal propagating on axis from 1 to 2 will be measured twice: first by 1 and then by 2. The difference will be a time shift of 'a'. The Laplace transform will differ by a factor of $e^{-as}$; the Fourier transform will be similar. Therefore, the equations may then be transformed to frequency space as follows:

$$F_-(t)-F_-(t)=F_{1-+}(t-a)+F_{2+-}(t+a)-F_{1-+}(t+a)-F_{2+-}(t-a) \quad (11)$$

$$T[F_+(t)-F_-(t)]\rightarrow e^{-as}f_{1-+}(s)+e^{as}f_{2+-}(s)-e^{as}f_{1-+}(s)-e^{-as}f_{2+-}(s) \quad (12)$$

$$e^{-as}T[F_+(t)-F_-(t)]\rightarrow e^{-2as}f_{1-+}(s)+f_{2+-}(s)-f_{1-+}(s)-e^{-2as}f_{2+-}(s) \quad (13)$$

$$e^{-as}T[F_+(t)]-e^{as}T[F_-(t)]\rightarrow e^{-as}f_0(s)+e^{-2as}f_{1-+}(s)+f_{2+-}(s)-e^{as}f_0(s)-e^{2as}f_{1-+}(s)-f_{2+-}(s)\rightarrow f_{1-+}(s)[e^{-2as}-e^{2as}]+f_0(s)[e^{-as}-e^{as}] \quad (14)$$

$$e^{as}T[F_+(t)]-e^{-as}T[F_-(t)]\rightarrow e^{as}f_0(s)+f_{1-+}(s)-e^{-as}f_0(s)-f_{1-+}(s)-e^{-2as}f_{2+-}(s)\rightarrow f_{2+-}(s)[e^{2as}-e^{-2as}]+f_0(s)[e^{as}-e^{-as}] \quad (15)$$

$$e^{-as}T[F_+(t)]-e^{as}T[F_-(t)]+e^{as}T[F_+(t)]-e^{-as}T[F_-(t)]\rightarrow f_{1-+}(s)[e^{-2as}-e^{2as}]+f_{2+-}(s)[e^{2as}-e^{-2as}] \quad (16)$$

$$T[F_+(t)-F_-(t)]\rightarrow f_{1-+}(s)[e^{-as}-e^{as}]+f_{2+-}(s)[e^{as}-e^{-as}] \quad (17)$$

$$A_1=e^{-as}T[F_+(t)]-e^{as}T[F_-(t)]+e^{as}T[F_+(t)]-e^{-as}T[F_-(t)]\rightarrow f_{1-+}(s)[e^{-as}-e^{2as}]+f_{2+-}(s)[e^{2as}-e^{-2as}] \quad (18)$$

$$A_1/[e^{-2as}-e^{2as}]=f_{1-+}(s)+f_{2+-}(s)[e^{2as}-e^{-2as}]/[e^{-2as}-e^{2as}] \quad (19)$$

$$T[F_+(t)-f_-(t)]/[e^{-as}-e^{as}]=f_{1-+}(s)+f_{2+-}(s)[e^{as}-e^{-as}]/[e^{-as}-e^{as}] \quad (20)$$

From the above, it may be stated that:

$$A_1/[e^{2as}-e^{-2as}]-T[F_+(t)-F_-(t)]/[e^{as}-e^{-as}]=f_{2+-}(s)\{[e^{2as}-e^{-2as}]/[e^{-2as}-e^{2as}]-[e^{as}-e^{-as}]/[e^{-as}-e^{as}]\} \quad (21)$$

Likewise, it may be stated that:

$$A_1/[e^{2as}-e^{-2as}]-T[F_+(t)-F_-(t)]/[e^{as}-e^{-as}]=f_{1-+}(s)\{[e^{-2as}-e^{2as}]/[e^{2as}-e^{-2as}]-[e^{-as}-e^{as}]/[e^{as}-e^{-as}]\} \quad (22)$$

Equations (21) and (22) enable finding $F_1$, which is signal 1 travelling from the "–" to the "+" direction, as well as finding $F_2$, which is signal 2 travelling from the "+" to the "–" direction. Based on $F_1$ and $F_2$, the appropriate directional speaker responses along this representative 'x' axis may be determined. The same algorithm is applied to the other two axes in the same way, and the full directional response may be calculated accordingly. Corrections are applied in the intermediate steps of the calculation (where the sampled waveform has been converted to frequency space) to account for the frequency response of the microphones and speakers, and any apparent frequency or phase shifts for off-axis waveform propagation directions.

Figure 8:
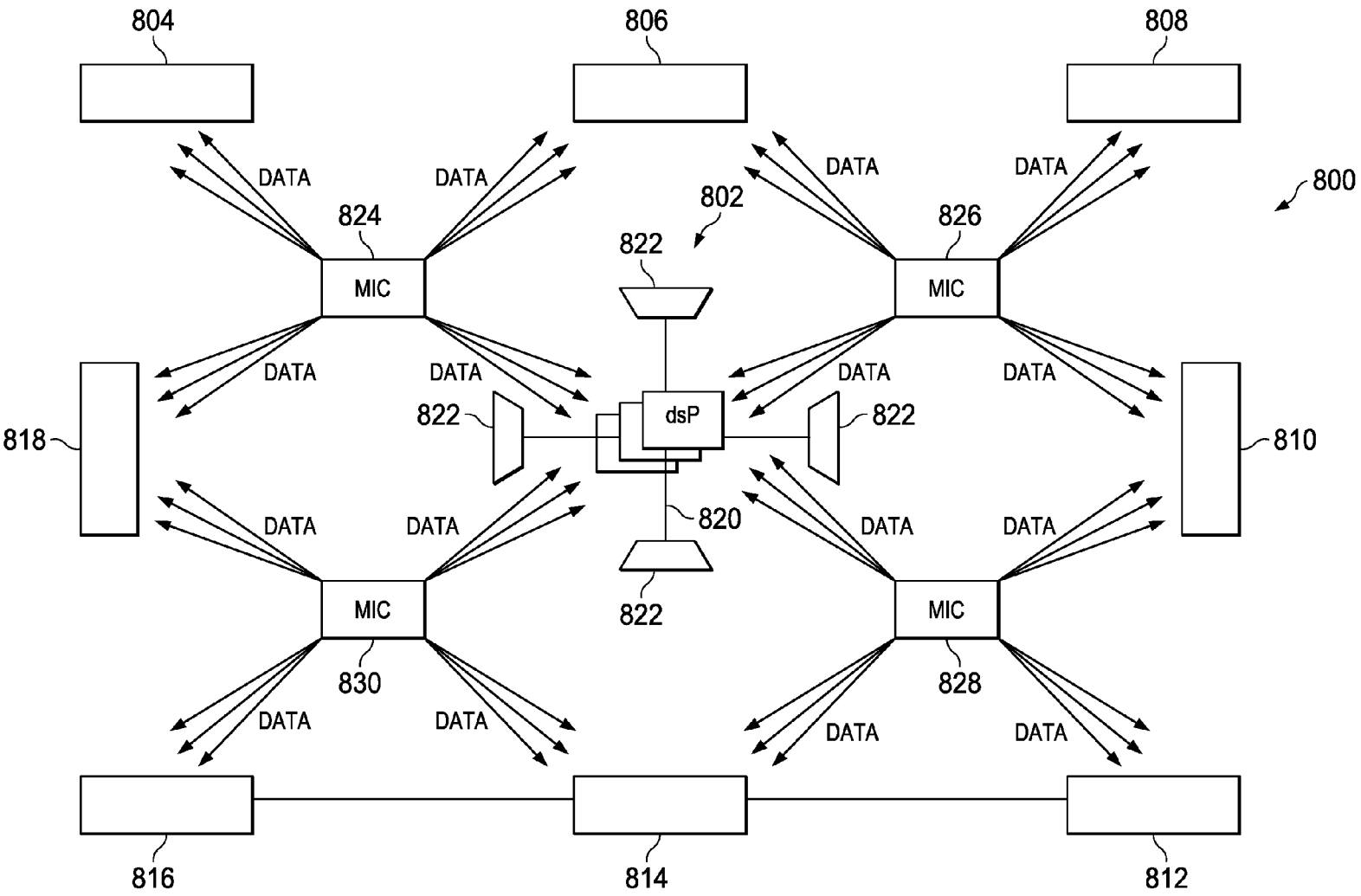
FIG. 8 illustrates an abstract relationship among cells to demonstrate connectivity among cells, in accordance with an illustrative embodiment.

FIG. 8 illustrates an abstract relationship among cells to demonstrate connectivity among cells, in accordance with an illustrative embodiment. FIG. 8 shows array of cells 800. Array of cells 800 may be array 300 of FIG. 3. Array of cells 800 includes cell 802. Cell 802 may be, for example, cell 500 of FIG. 5 through FIG. 7, cell 400 of FIG. 4, or cell 200 of FIG. 2.

Additional cells surround cell 802. These additional cells have similar features as cell 802, though are represented as simple boxes for ease of representation. Thus, for example, the array shown in FIG. 8 may include not only cell 802, but also cell 804, cell 806, cell 808, cell 810, cell 812, cell 814, cell 816, and cell 818. More or fewer cells may be present.

Cell 802, as well as the other cells, includes one or more digital signal processors, such as digital signal processors 820. While digital signal processors are recited, analog signal processors might also be used in certain illustrative embodiments. In an illustrative embodiment, one digital signal processor is provided for each cell for each coordinate axis; thus, the cells shown in FIG. 8 may have three digital signal processors each. Each digital signal processor along a given coordinate axis may perform direction-finding, as described above.

Cell 802, as well as the other cells, includes one or more speakers, such as speakers 822. Cell 802, as well as the other cells, includes one or more microphones, such as microphone 824, microphone 826, microphone 828, and microphone 830. Note that each of these microphones may be physically or wirelessly connected to digital signal processors 820.

As shown in FIG. 8, data may be transferred from one microphone to the digital signal processors of more than one cell. For example, microphone 824 may transfer data to the digital signal processors of each of cells cell 802, 804, 806, and 818, as well as possibly more cells. This same data may be transferred to a central computer that controls or programs all of the digital signal processors of the cells. Microphones may transfer data to fewer cells than those shown. Microphones may transfer data to digital signal processors in cells that are not contiguous with each other in certain illustrative embodiments.

Because the digital signal processors of different cells share microphone data, the response waveform within a local area near a given cell may be improved. In this manner, the total response waveform emitted by the entire array of cells may be improved, thereby achieving a more desirable modification of the incoming waveform.

Figure 9:
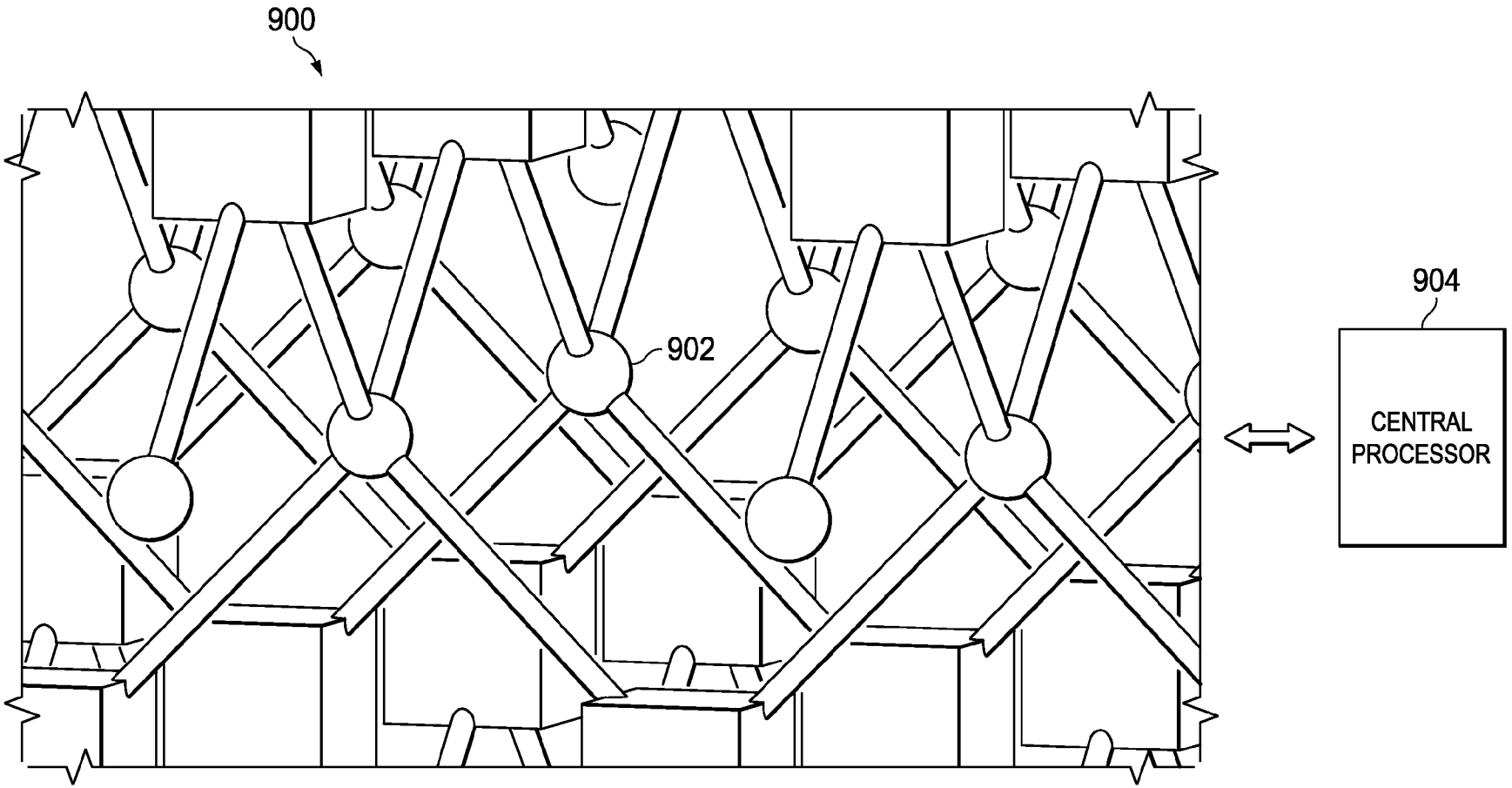
FIG. 9 illustrates an array of cells, such as the cell shown in FIG. 4, in accordance with an illustrative embodiment.
Figure 10:
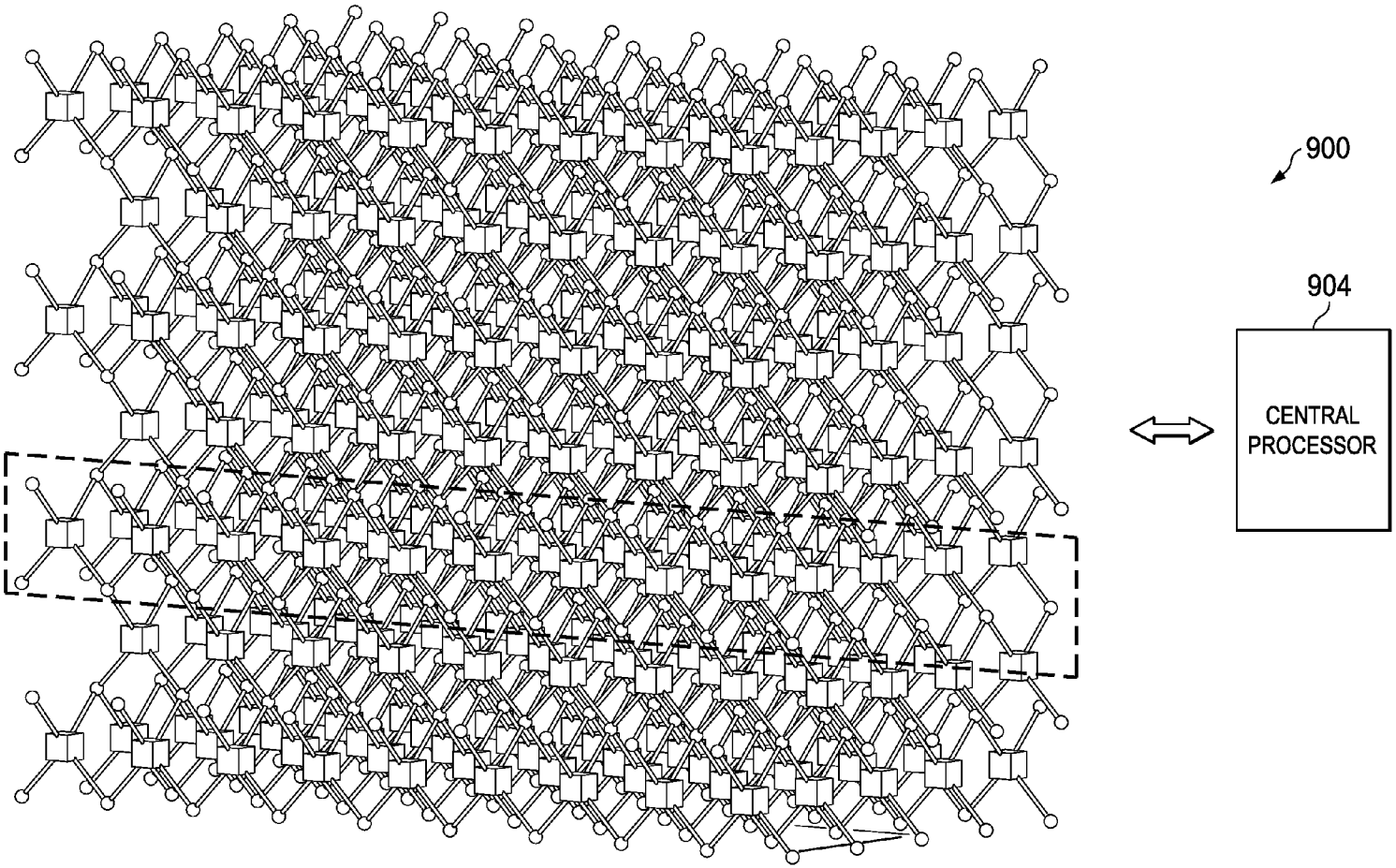
FIG. 10 illustrates another view of the array of cells shown in FIG. 9, in accordance with an illustrative embodiment.
Figure 11:
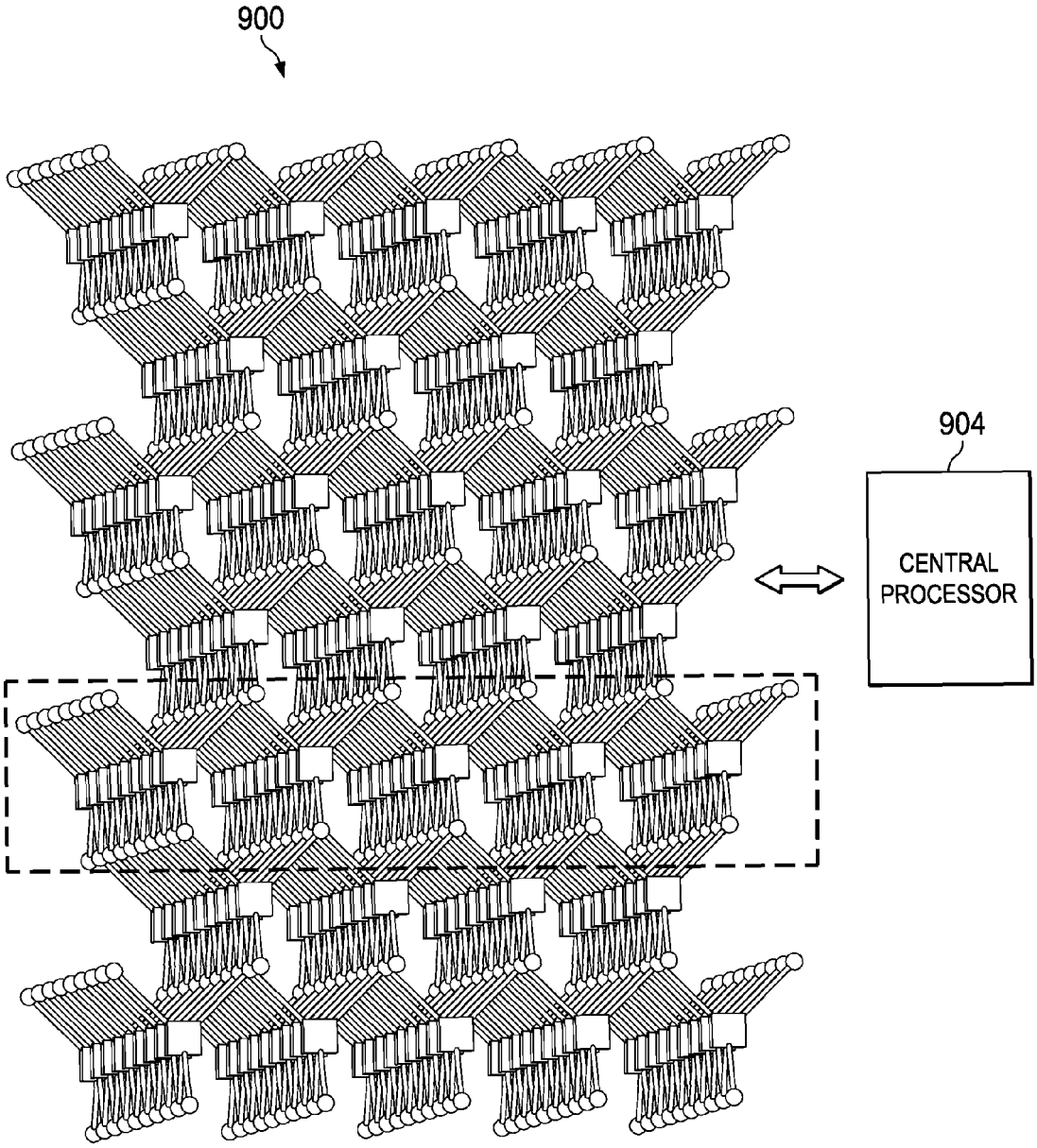
FIG. 11 illustrates another view of the array of cells shown in FIG. 9, in accordance with an illustrative embodiment.

FIG. 9 through FIG. 11 illustrate particular arrangements of arrays of tetrahedral cells. FIG. 9 through FIG. 11 are described together. Thus, similar reference numerals refer to similar objects for these three Figures.

In particular, FIG. 9 illustrates an array of cells, such as the cell shown in FIG. 4, in accordance with an illustrative embodiment. FIG. 10 illustrates another view of the array of cells shown in FIG. 9, in accordance with an illustrative embodiment. FIG. 11 illustrates another view of the array of cells shown in FIG. 9, in accordance with an illustrative embodiment.

In each of FIG. 9 through FIG. 11, array 900 may be array of cells 800 of FIG. 8 or array 300 of FIG. 3. Array 900 is a particular, non-limiting example of an array of tetrahedral cells, such as cell 400 shown in FIG. 4.

FIG. 9 shows a close-up view of array 900. Each microphone, such as microphone 902, is also a multi-node connecting a given cell to at least three other cells. In the illustrative embodiment of FIG. 9, each microphone is physically connected to the corresponding hubs of four cells. Thus, in this illustrative embodiment, four digital signal processors may be provided per cell to process the data for this multi-node arrangement, though more or fewer digital signal processors may be present per cell. Along the edges of array 900, each cell is connected to at least two other cells.

In any case, the physical interconnectivity of the cells provides array 900 an overall structural integrity, which may be light weight and strong. If desired, foam or other materials may be inserted into the empty spaces between hubs of nodes, thereby providing a solid substance. Alternatively, solid panels may cover a honeycomb structure in which the hubs are disposed.

In use, array 900 operates in a manner similar to array 300 of FIG. 3 or array of cells 800 of FIG. 8. An incoming sound waveform may strike array 900. In turn, each cell of array 900 will characterize a local area of the incoming sound wave, analyze the incoming sound wave in that local area, and then emit a response sound wave. The response sound wave is configured to modify the incoming sound wave, taking into account any differences in phase generated by the index of refraction between the outside medium and the acoustic metamaterial formed by array 900. In this illustrative embodiment, because each cell shares data from microphones of neighboring cells, the net response sound wave will in many cases closely approximate the incoming sound wave. As a result, assuming sufficient power and sound producing capacity is available to the speakers of the cells, the incoming sound waveform may be completely or nearly completely canceled. Thus, an acoustic metamaterial (a material that includes an array of cells, such as array 900) may be used to render silent vehicles, buildings, or the rooms of buildings.

For example, in certain illustrative embodiments, the sound produced by a jet engine may be completely or nearly completely canceled by forming the paneling of the engine from an acoustic metamaterial. Additionally, the sound of air flowing around an aircraft might be canceled by forming the fuselage skin from an acoustic metamaterial. Thus, in some illustrative embodiments, an aircraft having an acoustic metamaterial built as part of its fuselage and engine casings could be rendered nearly silent. Some sound is likely to escape due to the air ejected from the jet engine; however, the total sound produced by the aircraft may be dramatically reduced.

In the case of buildings or rooms within buildings, sounds generated within the building may be rendered silent. Thus, for example, a security room may be built using walls from an acoustic metamaterial, where sound essentially cannot pass outside the room. Likewise, an entertainment room could be created using walls or objects within a room formed from an acoustic metamaterial, whereby certain sounds could be modified and then sent back to a listener.

Array 900 is an example of a structural metamaterial wherein the cells are tetrahedral cells and a cell at an edge of the structural metamaterial is electrically connected with at least two other cells. A given interior cell inside of the edge is electrically connected with at least four other tetrahedral cells.

In an illustrative embodiment, one or more cells in array 900 may be connected to central processor 904. In an illustrative embodiment, all of the cells in array 900 are connected to central processor 904. Central processor 904 may be connected to the cells in array 900 either wirelessly or with wires. Central processor 904 may be connected to the cells in array 900 continuously, or only at desired times. Central processor 904 may be configured to program or re-program the operation of the digital signal processors in the cells of array 900. In this manner, how array 900 modifies incoming sound waves may be changed, possibly in real time. Thus, for example, using central processor 904 in conjunction with array 900, an aircraft may be programmed to be silent at one point in time and to emit even louder noise, or a different noise, at another point in time. Thus, for example, a jet aircraft could go from being silent to sounding like a larger jet aircraft to sounding like a helicopter in real time.

As used herein the term "in real time" is defined as accomplishing an act without a significant delay with respect to the time that the incoming sound waves propagate through array 900. An example of real time is the characterization of the incoming sound wave plus the emission of the emitted sound wave within tens of microseconds.

Many more examples are possible. Thus, the illustrative embodiments are not necessarily limited to those specific examples described above or elsewhere herein.

Figure 12:
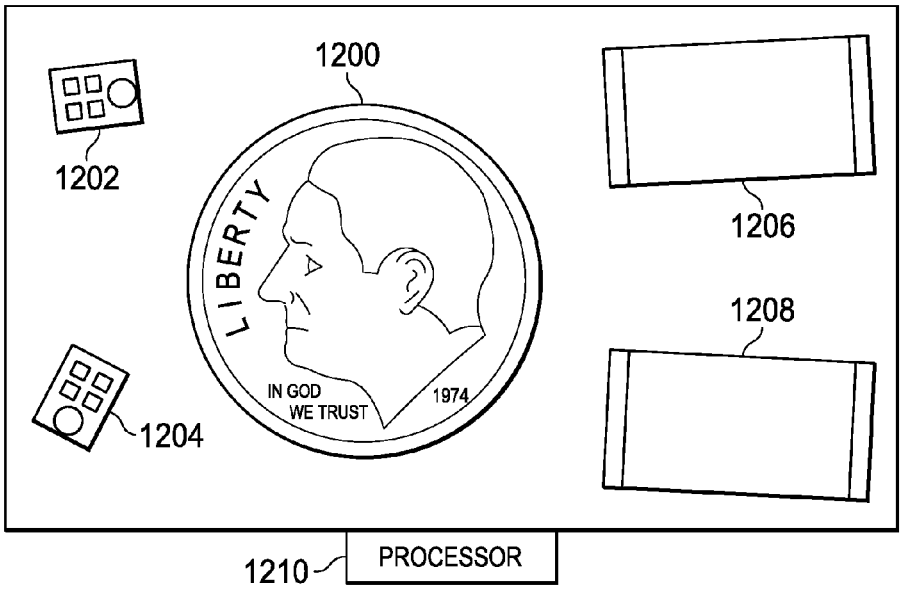
FIG. 12 illustrates components used in a cell, such as the cell shown in FIG. 4, in accordance with an illustrative embodiment.

FIG. 12 illustrates components used in a cell, such as the cell shown in FIG. 4, in accordance with an illustrative embodiment. The various components shown in FIG. 12 are compared to dime 1200 to indicate a size of the components used to build a digital signal processor. These components are exemplary only, and may be further reduced in size.

For example, a cell may include one or more microphones, such as microphone 1202 or microphone 1204. In a specific, non-limiting illustrative embodiment, microphones may be sensitive between about 20 Hz and 20 kHz, with built-in audio amplification and a digital interface. Each such microphone is relatively inexpensive, less than $10. These microphones may be replaced with other sound sensors.

A cell may also include one or more speakers, such as speaker 1206 or speaker 1208. In a specific illustrative embodiment, these speakers may be 10 mW speaker with a frequency response between about 200 Hz to 8 kHz. The frequency response may be changed to match the frequency response of the microphones. These speakers may be relatively inexpensive, less than $10.

A cell may also include processor 1210. Processor 1210 may be a digital signal processor or an analog signal processor, depending on the preferred use of the processor. In a specific illustrative embodiment, processor 1210 may be a dsPIC33F processor chip, which is available relatively inexpensively, less than $10. This chip may have an onboard math engine, a USB or other digital interfaces, and may incorporate other hardware-specific features directed towards performing the mathematical processing described above.

These components are non-limiting examples. Other components may be used. The components may be larger or smaller. Thus, the illustrative embodiments shown in FIG. 12 do not necessarily limit the claimed inventions or the other illustrative embodiments described herein.

Figure 13:
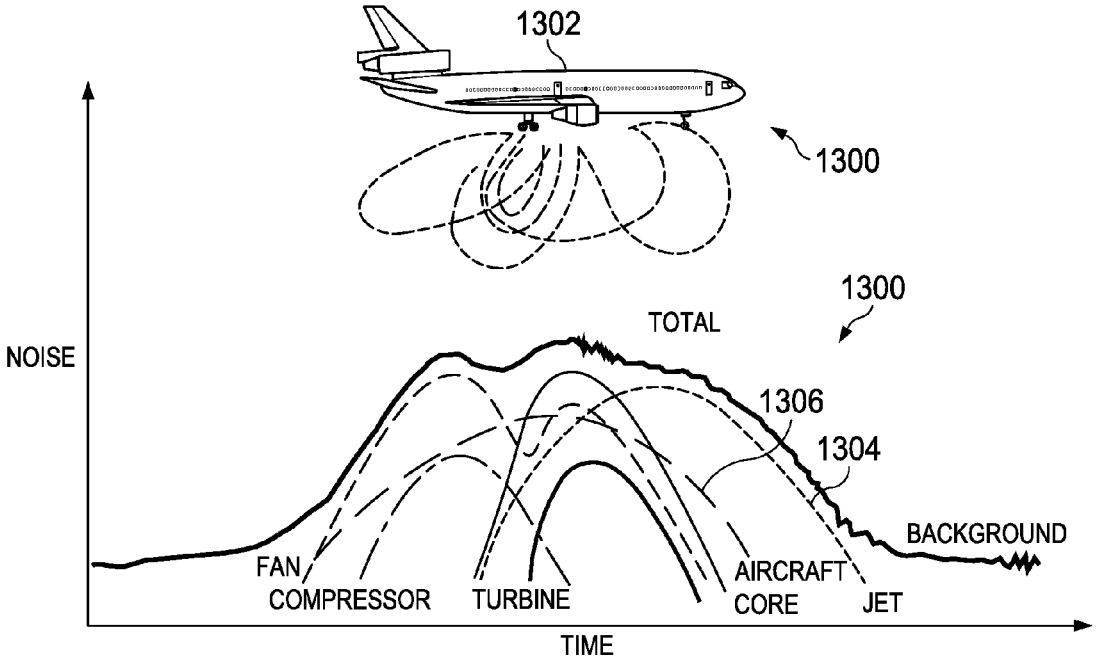
FIG. 13 illustrates an application of the array of cells shown in FIG. 3 or FIG. 9, in accordance with an illustrative embodiment.

FIG. 13 illustrates an application of the array of cells shown in FIG. 3 or FIG. 9, in accordance with an illustrative embodiment. FIG. 13 is taken from National Aeronautics and Space Administration Publication 1258, Volume 2, WRDC Technical Report 90-3052 from August of 1991 (Aeroacoustics of Flight Vehicles: Theory and Practice;

Volume 2: Noise Control). FIG. 13 provides examples of different types of incoming sound waveforms 1300.

The illustrative embodiments described with respect to FIG. 2 through FIG. 12 are capable of canceling, modifying, or amplifying sound waveforms 1300. Waveforms 1300 may be modified by an acoustic metamaterial located at one or more areas of aircraft 1302. Thus, for example, an acoustic metamaterial surrounding the jet engines might cancel jet acoustic waveform 1304, though it may cancel other waveforms as well because the cells of the acoustic metamaterial will analyze the total superimposed waveform striking that acoustic metamaterial. Similarly, an acoustic metamaterial that forms the skin of the fuselage might cancel airframe core waveform 1306, though it may cancel other waveforms because the cells of the acoustic metamaterial will analyze the total superimposed waveform striking that acoustic metamaterial. Nevertheless, specific areas of aircraft 1302 may have differently programmed acoustic meta-materials to aid in cancelling or modifying dominant waveforms within waveforms 1300. Again, however, the acoustic metamaterial on any given part of an aircraft 1302 could cancel or modify even a highly complex sound waveform that includes the superposition of any or all of the sources of noise shown in waveforms 1300.

Figure 14:
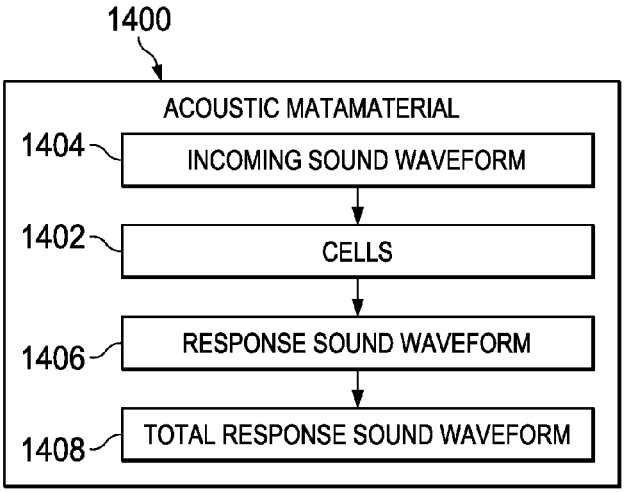
FIG. 14 illustrates an acoustic metamaterial, in accordance with an illustrative embodiment.

FIG. 14 illustrates an acoustic metamaterial, in accordance with an illustrative embodiment. Acoustic metamaterial 1400 may be formed by or from an array of cells, such as array 300 of FIG. 3, array of cells 800 of FIG. 8, or array 900 of FIG. 9. These arrays may include cells such as cell 200 of FIG. 2, cell 400 of FIG. 4, cell 500 of FIG. 5 through FIG. 7, or cell 802 of FIG. 8. Acoustic metamaterial 1400 may include additional structures to provide other functions, such as support, strength, connectivity, or other desired functions.

Acoustic metamaterial 1400 includes cells 1402 to digitally process incoming sound waveform 1404 and to produce corresponding response sound waveform 1406 as a function of a frequency and a phase of incoming sound waveform 1404, to produce total response sound waveform 1408, that when combined with incoming sound waveform 1404, modifies incoming sound waveform 1404. In an illustrative embodiment, cells 1402 detect and model incoming sound waveform 1404 in three-dimensional directions to create a three-dimensional sound response regardless of an angle of incidence of incoming sound waveform 1404.

In an illustrative embodiment, each cell of cells 1402 comprises at least one microphone, signal processor and speaker. In an illustrative embodiment, cells 1402 are interconnected. In this case, corresponding electronic components are electrically coupled to each cell, to convert the incoming sound waveform into digital signals.

In an illustrative embodiment, the corresponding electronic components further comprise a corresponding signal processor that calculates all detected propagating acoustic energy in three-dimensions and applies predetermined time delay, phase shift, and amplification factors to the incoming sound waveform as a function of frequency. In this case, wherein each cell is programmed with the time delay, phase-shift and amplification factors over frequency to perform active cancellation of the detected sound as the incoming sound waveform propagates through and past each of the cells. Still further, the corresponding electronic components each further comprise a plurality of acoustic transducers that directionally transmit the corresponding response waveform and, as a whole, all of the corresponding electronic components directionally transmit the sum of the corresponding response waveforms as the total response sound waveform.

In an illustrative embodiment, each corresponding signal processor is electrically coupled to another signal processor in another cell. A central processor may program each corresponding signal processor.

The illustrative embodiments shown in FIG. 14 may be varied. For example while FIG. 14 may be interpreted as indicating that incoming sound waveform 1404 moves through cells 1402 and is combined with response sound waveform 1406 on the other side of cells 1402, other interpretations are possible. For example, incoming sound waveform could strike cells 1402, be analyzed, and reflect from cells 1402. In this case, response sound waveform 1406 would be emitted from the same side as incoming sound waveform 1404. Thus, response sound waveform 1406 could be placed between cells 1402 and incoming sound waveform 1404. In other illustrative embodiment, multiple response waveforms may be produced. For example, cells 1402 may produce a first response waveform that modifies a first part of incoming sound waveform 1404 that reflects from cells 1402, and cells 1402 may also produce a second response waveform that modifies a second part of incoming sound waveform 1404 that passes through cells 1402.

Figure 15:
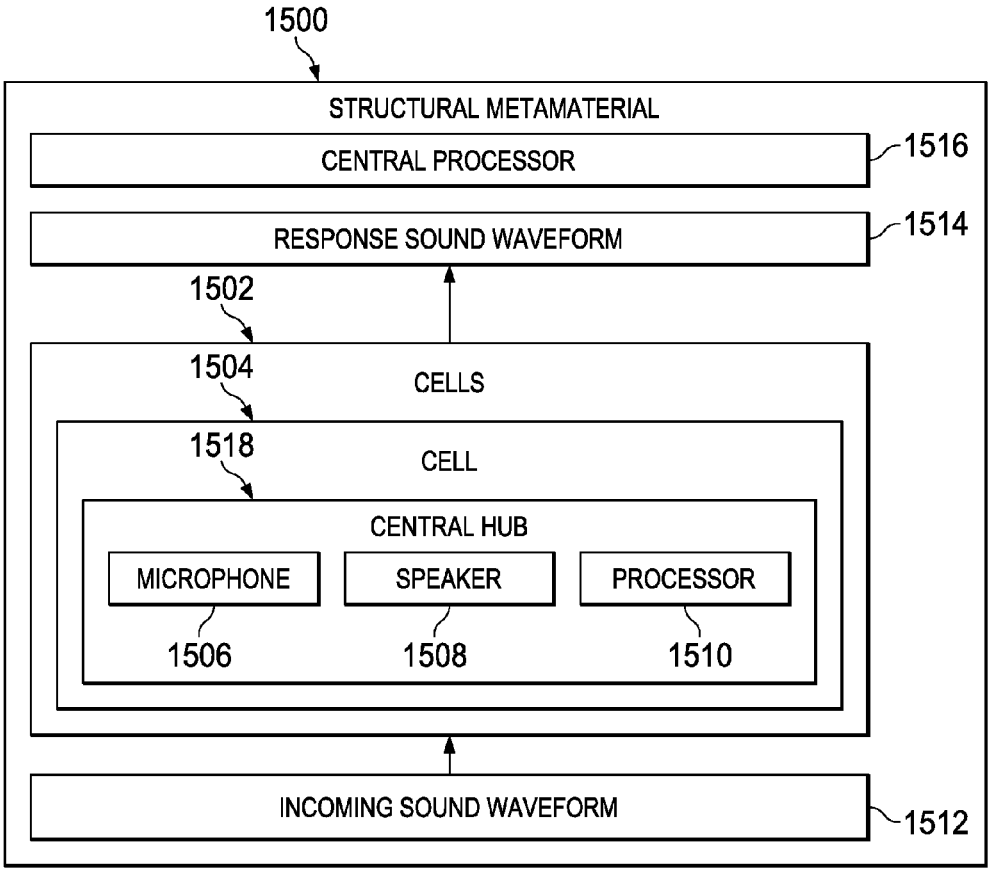
FIG. 15 illustrates a structural metamaterial, in accordance with an illustrative embodiment.

FIG. 15 illustrates a structural metamaterial, in accordance with an illustrative embodiment. Structural metamaterial 1500 may be formed by or from an array of cells, such as array 300 of FIG. 3, array of cells 800 of FIG. 8, or array 900 of FIG. 9. These arrays may include cells such as cell 200 of FIG. 2, cell 400 of FIG. 4, cell 500 of FIG. 5 through FIG. 7, or cell 802 of FIG. 8. Structural metamaterial 1500 may include additional structures to provide other functions, such as support, strength, connectivity, or other desired functions. Structural metamaterial 1500 may be a variation of acoustic metamaterial 1400 of FIG. 14.

Structural metamaterial 1500 may include cells 1502, each cell 1504 containing microphone 1506 to detect incoming sound waveforms, speaker 1508, and processor 1510 configured to analyze the features of incoming sound waveform 1512 and to cause speaker 1508 to emit response sound waveform 1514 that, when combined with incoming sound waveform 1512 at a given corresponding cell 1504, modifies incoming sound waveform 1512.

In an illustrative embodiment, the features of incoming sound waveform analyzed are selected from the group consisting of a corresponding phase, a corresponding direction, a corresponding frequency, and a corresponding amplitude of the incoming sound waveform at the given corresponding cell. In an illustrative embodiment, cells 1502 are tetrahedral cells and a cell at an edge of the structural meta-material is electrically connected with at least two other cells, and wherein a given interior cell inside of the edge is electrically connected with at least four other tetrahedral cells.

In an illustrative embodiment, structural metamaterial 1500 may include central processor 1516 configured to control the processor 1510 of each cell 1504. In this case, central processor 1516 may be further configured to reprogram processor 1510 of each cell 1504 to further modify incoming sound waveform 1512.

In an illustrative embodiment, structural metamaterial 1500 may also include central hub 1518 containing processor 1510 of each cell 1504 and speaker 1508 of each cell 1504. In this case, structural metamaterial 1500 may also include a set of four beams, each comprising a solid material and further comprising a digital communications line. Additionally, structural metamaterial 1500 may include a set of four sensors connected at corresponding ends of the set of four beams, opposite the central hub of each cell. The sensors may instances of microphone 1506, or may be other sensors. In an illustrative embodiment, central hub 1518 of each cell 1504 contains a plurality of additional separate processors and a plurality of additional separate speakers.

The illustrative embodiments described with respect to FIG. 15 may be varied. More or fewer features may be present. Cells 1502 could take the form of an array, such as array 300 of FIG. 3 or array 900 shown in FIGS. 9-11. Thus, the description of FIG. 15 does not necessarily limit the claimed inventions.

Figure 16:
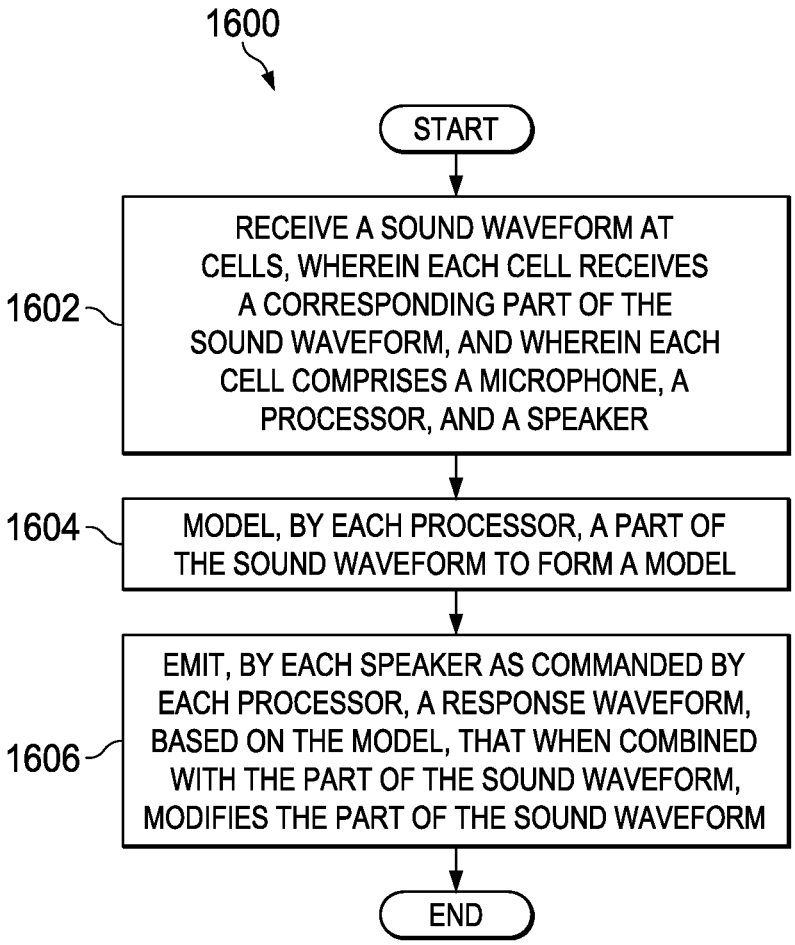
FIG. 16 illustrates a method of modifying sound, in accordance with an illustrative embodiment.

FIG. 16 illustrates a method of modifying sound, in accordance with an illustrative embodiment. Method 1600 may be implemented using an array of cells, such as array 300 of FIG. 3, array of cells 800 of FIG. 8, or array 900 of FIG. 9. Method 1600 may also be implemented using cells such as cell 200 of FIG. 2, cell 400 of FIG. 4, cell 500 of FIG. 5 through FIG. 7, or cell 802 of FIG. 8. Method 1600 may be implemented using acoustic metamaterial 1400 of FIG. 14 or structural metamaterial 1500 of FIG. 15.

In an illustrative embodiment, method 1600 may begin by receiving a sound waveform at cells, wherein each cell receives a corresponding part of the sound waveform, and wherein each cell comprises a microphone, a processor, and a speaker (operation 1602). Method 1600 may also include modeling, by each processor, a part of the sound waveform to form a model (operation 1604). Method 1600 may also include emitting, by each speaker as commanded by each processor, a response waveform, based on the model, that when combined with the part of the sound waveform, modifies the part of the sound waveform (operation 1606). The process may terminate thereafter.

Method 1600 may be varied. For example, method 1600 may further include controlling each processor by a central processor to modify each response waveform. Method 1600 may further include modifying the sound waveform by canceling the sound waveform. Method 1600 may further include modifying the sound waveform by one of amplifying the sound waveform or changing the sound waveform. Thus, the illustrative embodiments described with respect to FIG. 16 do not necessarily limit the claimed inventions or the other illustrative embodiments described elsewhere herein.

Figure 17:
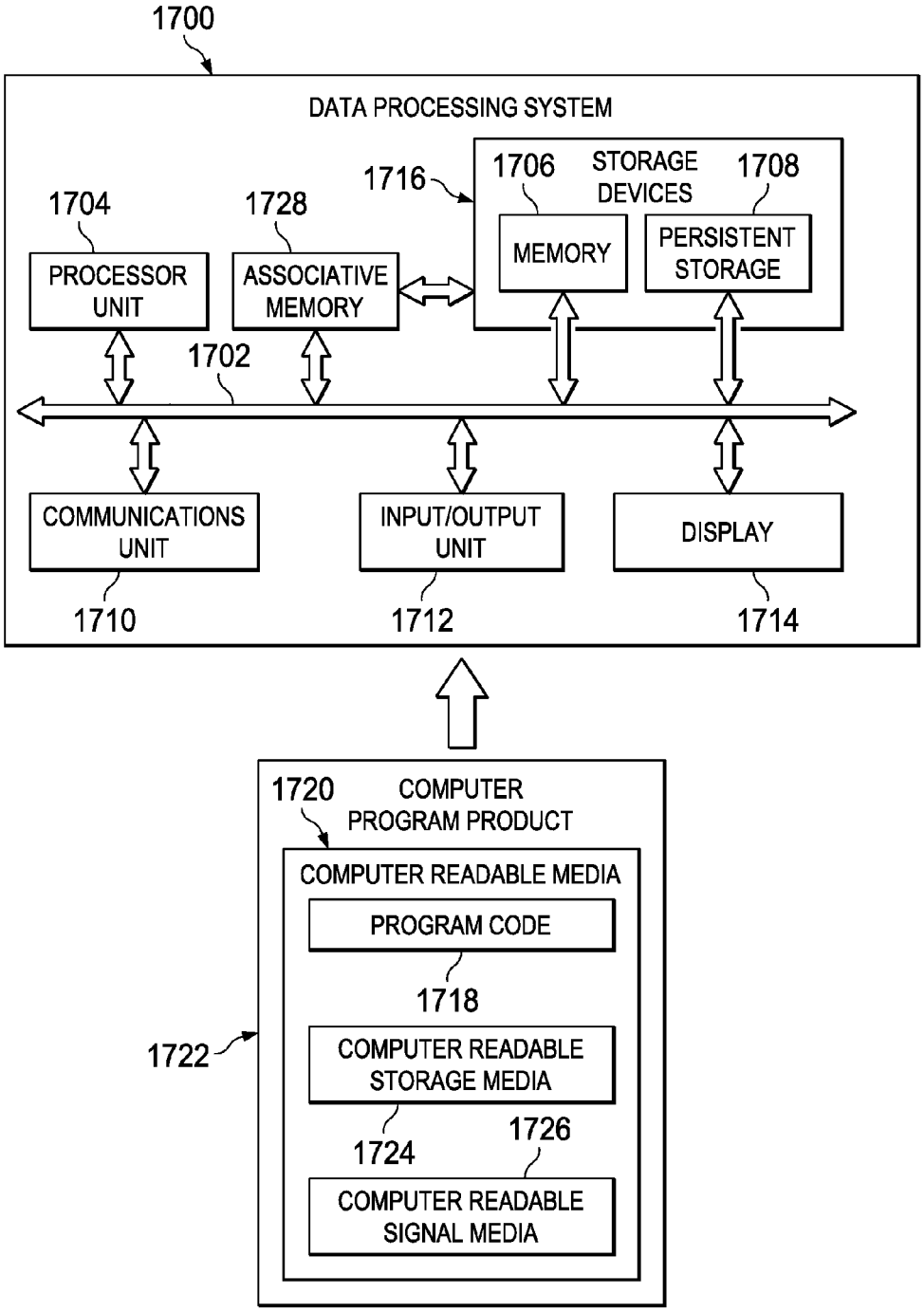
FIG. 17 is an illustration of a data processing system, in accordance with an illustrative embodiment.

Turning now to FIG. 17, an illustration of a data processing system is depicted in accordance with an illustrative embodiment. Data processing system 1700 in FIG. 17 is an example of a data processing system that may be used to implement the illustrative embodiments, such as method 1600 of FIG. 16, the characterization of fluorescing light from FIG. 1 through FIG. 13, or any other module or system or process disclosed herein. In this illustrative example, data processing system 1700 includes communications fabric 1702, which provides communications between processor unit 1704, memory 1706, persistent storage 1708, communications unit 1710, input/output (I/O) unit 1712, and display 1714.

Processor unit 1704 serves to execute instructions for software that may be loaded into memory 1706. Processor unit 1704 may be a number of processors, a multi-processor core, or some other type of processor, depending on the particular implementation. A number, as used herein with reference to an item, means one or more items. Further, processor unit 1704 may be implemented using a number of heterogeneous processor systems in which a main processor is present with secondary processors on a single chip. As another illustrative example, processor unit 1704 may be a symmetric multi-processor system containing multiple processors of the same type.

Memory 1706 and persistent storage 1708 are examples of storage devices 1716. A storage device is any piece of hardware that is capable of storing information, such as, for example, without limitation, data, program code in functional form, and/or other suitable information either on a temporary basis and/or a permanent basis. Storage devices 1716 may also be referred to as computer readable storage devices in these examples. Memory 1706, in these examples, may be, for example, a random access memory or any other suitable volatile or non-volatile storage device. Persistent storage 1708 may take various forms, depending on the particular implementation.

For example, persistent storage 1708 may contain one or more components or devices. For example, persistent storage 1708 may be a hard drive, a flash memory, a rewritable optical disk, a rewritable magnetic tape, or some combination of the above. The media used by persistent storage 1708 also may be removable. For example, a removable hard drive may be used for persistent storage 1708.

Communications unit 1710, in these examples, provides for communications with other data processing systems or devices. In these examples, communications unit 1710 is a network interface card. Communications unit 1710 may provide communications through the use of either or both physical and wireless communications links.

Input/output (I/O) unit 1712 allows for input and output of data with other devices that may be connected to data processing system 1700. For example, input/output (I/O) unit 1712 may provide a connection for user input through a keyboard, a mouse, and/or some other suitable input device. Further, input/output (I/O) unit 1712 may send output to a printer. Display 1714 provides a mechanism to display information to a user.

Instructions for the operating system, applications, and/or programs may be located in storage devices 1716, which are in communication with processor unit 1704 through communications fabric 1702. In these illustrative examples, the instructions are in a functional form on persistent storage 1708. These instructions may be loaded into memory 1706 for execution by processor unit 1704. The processes of the different embodiments may be performed by processor unit 1704 using computer implemented instructions, which may be located in a memory, such as memory 1706.

These instructions are referred to as program code, computer usable program code, or computer readable program code that may be read and executed by a processor in processor unit 1704. The program code in the different embodiments may be embodied on different physical or computer readable storage media, such as memory 1706 or persistent storage 1708.

Program code 1718 is located in a functional form on computer readable media 1720 that is selectively removable and may be loaded onto or transferred to data processing system 1700 for execution by processor unit 1704. Program code 1718 and computer readable media 1720 form computer program product 1722 in these examples. In one example, computer readable media 1720 may be computer readable storage media 1224 or computer readable signal media 1726. Computer readable storage media 1224 may include, for example, an optical or magnetic disk that is inserted or placed into a drive or other device that is part of persistent storage 1708 for transfer onto a storage device, such as a hard drive, that is part of persistent storage 1708. Computer readable storage media 1224 also may take the form of a persistent storage, such as a hard drive, a thumb drive, or a flash memory, that is connected to data processing system 1700. In some instances, computer readable storage media 1224 may not be removable from data processing system 1700.

Alternatively, program code 1718 may be transferred to data processing system 1700 using computer readable signal media 1726. Computer readable signal media 1726 may be, for example, a propagated data signal containing program code 1718. For example, computer readable signal media 1726 may be an electromagnetic signal, an optical signal, and/or any other suitable type of signal. These signals may be transmitted over communications links, such as wireless communications links, optical fiber cable, coaxial cable, a wire, and/or any other suitable type of communications link. In other words, the communications link and/or the connection may be physical or wireless in the illustrative examples.

In some illustrative embodiments, program code 1718 may be downloaded over a network to persistent storage 1708 from another device or data processing system through computer readable signal media 1726 for use within data processing system 1700. For instance, program code stored in a computer readable storage medium in a server data processing system may be downloaded over a network from the server to data processing system 1700. The data processing system providing program code 1718 may be a server computer, a client computer, or some other device capable of storing and transmitting program code 1718.

The different components illustrated for data processing system 1700 are not meant to provide architectural limitations to the manner in which different embodiments may be implemented. The different illustrative embodiments may be implemented in a data processing system including components in addition to or in place of those illustrated for data processing system 1700. Other components shown in FIG. 17 can be varied from the illustrative examples shown. The different embodiments may be implemented using any hardware device or system capable of running program code. As one example, the data processing system may include organic components integrated with inorganic components and/or may be comprised entirely of organic components excluding a human being. For example, a storage device may be comprised of an organic semiconductor.

In another illustrative example, processor unit 1704 may take the form of a hardware unit that has circuits that are manufactured or configured for a particular use. This type of hardware may perform operations without needing program code to be loaded into a memory from a storage device to be configured to perform the operations.

For example, when processor unit 1704 takes the form of a hardware unit, processor unit 1704 may be a circuit system, an application specific integrated circuit (ASIC), a programmable logic device, or some other suitable type of hardware configured to perform a number of operations. With a programmable logic device, the device is configured to perform the number of operations. The device may be reconfigured at a later time or may be permanently configured to perform the number of operations. Examples of programmable logic devices include, for example, a programmable logic array, programmable array logic, a field programmable logic array, a field programmable gate array, and other suitable hardware devices. With this type of implementation, program code 1718 may be omitted because the processes for the different embodiments are implemented in a hardware unit.

In still another illustrative example, processor unit 1704 may be implemented using a combination of processors found in computers and hardware units. Processor unit 1704 may have a number of hardware units and a number of processors that are configured to run program code 1718. With this depicted example, some of the processes may be implemented in the number of hardware units, while other processes may be implemented in the number of processors.

As another example, a storage device in data processing system 1700 is any hardware apparatus that may store data. Memory 1706, persistent storage 1708, and computer readable media 1720 are examples of storage devices in a tangible form.

In another example, a bus system may be used to implement communications fabric 1702 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 1706, or a cache, such as found in an interface and memory controller hub that may be present in communications fabric 1702.

Data processing system 1700 may also include associative memory 1728. Associative memory 1728 may be termed a content-addressable memory. Associative memory 1728 may be in communication with communications fabric 1702. Associative memory 1728 may also be in communication with, or in some illustrative embodiments, be considered part of storage devices 1716. While one associative memory 1728 is shown, additional associative memories may be present. Associative memory 1728 may be a non-transitory computer readable storage medium for use in implementing instructions for any computer-implemented method described herein.

The different illustrative embodiments can take the form of an entirely hardware embodiment, an entirely software embodiment, or an embodiment containing both hardware and software elements. Some embodiments are implemented in software, which includes but is not limited to forms such as, for example, firmware, resident software, and microcode.

Furthermore, the different embodiments can take the form of a computer program product accessible from a computer usable or computer readable medium providing program code for use by or in connection with a computer or any device or system that executes instructions. For the purposes of this disclosure, a computer usable or computer readable medium can generally be any tangible apparatus that can contain, store, communicate, propagate, or transport the program for use by or in connection with the instruction execution system, apparatus, or device.

The computer usable or computer readable medium can be, for example, without limitation an electronic, magnetic, optical, electromagnetic, infrared, or semiconductor system, or a propagation medium. Non-limiting examples of a computer readable medium include a semiconductor or solid state memory, magnetic tape, a removable computer diskette, a random access memory (RAM), a read-only memory (ROM), a rigid magnetic disk, and an optical disk. Optical disks may include compact disk-read only memory (CD-ROM), compact disk-read/write (CD-R/W), and DVD.

Further, a computer usable or computer readable medium may contain or store a computer readable or usable program code such that when the computer readable or usable program code is executed on a computer, the execution of this computer readable or usable program code causes the computer to transmit another computer readable or usable program code over a communications link. This communications link may use a medium that is, for example without limitation, physical or wireless.

A data processing system suitable for storing and/or executing computer readable or computer usable program code will include one or more processors coupled directly or indirectly to memory elements through a communications fabric, such as a system bus. The memory elements may include local memory employed during actual execution of the program code, bulk storage, and cache memories which provide temporary storage of at least some computer readable or computer usable program code to reduce the number of times code may be retrieved from bulk storage during execution of the code.

Input/output or I/O devices can be coupled to the system either directly or through intervening I/O controllers. These devices may include, for example, without limitation, keyboards, touch screen displays, and pointing devices. Different communications adapters may also be coupled to the system to enable the data processing system to become coupled to other data processing systems or remote printers or storage devices through intervening private or public networks. Non-limiting examples of modems and network adapters are just a few of the currently available types of communications adapters.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An acoustic metamaterial comprising:

cells that detect and digitally process an incoming sound waveform in three dimensions, and produce a corresponding response sound waveform as a function of a frequency and a phase of the incoming sound waveform, to produce a response sound waveform in three dimensions that, when combined with the incoming sound waveform, produces a modified sound waveform, wherein the cells are tetrahedral cells and a cell at an edge of the structural metamaterial is electrically connected with at least two other cells, and wherein a given interior cell inside of the edge is electrically connected with at least four other tetrahedral cells.

2. The acoustic metamaterial of claim 1, wherein each cell comprises at least one microphone, signal processor and speaker.

3. The acoustic metamaterial of claim 1, wherein the cells are interconnected, the acoustic metamaterial further comprising:

corresponding electronic components electrically coupled to each cell, to convert the incoming sound waveform into digital signals.

4. The acoustic metamaterial of claim 3, wherein the corresponding electronic components further comprise a corresponding signal processor that calculates detected propagating acoustic energy in three dimensions and applies predetermined time delay, phase shift, and amplification factors to the incoming sound waveform as a function of frequency.

5. The acoustic metamaterial of claim 4, wherein each cell is programmed with the time delay, phase-shift and amplification factors over frequency to perform active cancellation of the detected sound as the incoming sound waveform propagates through and past each of the cells.

6. The acoustic metamaterial of claim 5, wherein the corresponding electronic components each further comprise a plurality of acoustic transducers that directionally transmit the corresponding response waveform and, as a whole, all of the corresponding electronic components directionally transmit the sum of the corresponding response waveforms as a total response sound waveform.

7. The acoustic metamaterial of claim 6, wherein each corresponding signal processor is electrically coupled to another signal processor in another cell.

8. The acoustic metamaterial of claim 7, wherein a central processor programs each corresponding signal processor.

9. The acoustic metamaterial of claim 1, wherein the cells are arranged as part of a skin of a vehicle.

10. The acoustic metamaterial of claim 9, wherein the vehicle comprises an aircraft.

11. The acoustic metamaterial of claim 1, wherein the cells are arranged as part of an outside surface of a structure selected from the group consisting of a panel and a wall.

12. A structural metamaterial comprising:

cells, each cell containing a microphone to detect incoming sound waveforms, a speaker, and a processor configured to analyze features of an incoming sound waveform and to cause the speaker to emit a response waveform that, when combined with the incoming sound waveform at a given corresponding cell, modifies at least part of the incoming sound waveform, wherein the cells are tetrahedral cells and a cell at an edge of the structural metamaterial is electrically connected with at least two other cells, and wherein a given interior cell inside of the edge is electrically connected with at least four other tetrahedral cells.

13. The structural metamaterial of claim 12, wherein the features of an incoming sound waveform analyzed are selected from the group consisting of a corresponding phase, a corresponding direction, a corresponding frequency, and a corresponding amplitude of the incoming sound waveform at the given corresponding cell.

14. The structural metamaterial of claim 12 further comprising:

a central processor configured to control the processor of each cell.

15. The structural metamaterial of claim 14, wherein the central processor is further configured to re-program the processor of each cell to further modify the incoming sound waveform.

16. The structural metamaterial of claim 12, wherein each of the cells comprises:

a central hub containing the processor of each cell and the speaker of each cell;

a set of four beams, each comprising a solid material and further comprising a digital communications line; and a set of four sensors connected at corresponding ends of the set of four beams, opposite the central hub of each cell.

17. The structural metamaterial of claim 16, wherein the central hub of each cell contains a plurality of additional separate processors and a plurality of additional separate speakers.

18. The structural metamaterial of claim 12, wherein the cells are arranged as part of a skin of a vehicle.

19. The structural metamaterial of claim 12, wherein the cells are arranged as part of an outside surface of a structure selected from the group consisting of an aircraft, a panel, and a wall.

* * * * *